US005795705A

United States Patent [19]

Kawamoto

[11] Patent Number: 5,795,705

[45] Date of Patent: Aug. 18, 1998

[54] METHOD FOR PREPARING PHOTOSENSITIVE FILM, PHOTOGRAPHIC PHOTOSENSITIVE FILM, AND PHOTOGRAPHIC CARTRIDGE

[75] Inventor: Fumio Kawamoto, Kanagawa, Japan

[73] Assignee: Fugi Photo Film Co., Ltd., Minami-ashigara, Japan

[21] Appl. No.: 683,850

[22] Filed: Jul. 19, 1996

[51] Int. Cl.[6] ..... G03C 1/76

[52] U.S. Cl. ..... 430/501; 430/533; 242/348; 242/348.4

[58] Field of Search ..... 430/533, 501; 242/348, 348.4

[56] References Cited

U.S. PATENT DOCUMENTS 5,462,824 10/1995 Kawamoto et al. ..... 430/533
5,580,707 12/1996 Kawamoto ..... 430/533

FOREIGN PATENT DOCUMENTS

A-6-35118 2/1994 Japan ..... G03C 1/795

*Primary Examiner*—Mark F. Huff
*Attorney, Agent, or Firm*—Burns, Doane, Swecker & Mathis, LLP

[57] ABSTRACT

A method for preparing a photographic photosensitive film comprising a support and formed on at least one side thereof photographic constituent layers containing a photosensitive silver halide emulsion layer is disclosed, which comprises subjecting the photographic photosensitive film to an "out-of-roll curling treatment" so as to result in an outermost-lap curl value of from 55 $m^{-1}$ to 200 $m^{-1}$ as measured after the treated film is housed in a cartridge, with the emulsion layer side facing inward. Also disclosed are a photographic photosensitive film which comprises a support and formed on at least one side thereof photographic constituent layers containing a photosensitive silver halide emulsion layer and has been prepared by the above method, and a photographic film cartridge containing housed therein the above photographic photosensitive film so that a front end part of the film is out of the cartridge over a length of at least 1 cm. The photographic cartridge and the photographic photosensitive film have excellent in-camera handleability. A polyester is the most suitable material of the support.

10 Claims, No Drawings

METHOD FOR PREPARING PHOTOSENSITIVE FILM, PHOTOGRAPHIC PHOTOSENSITIVE FILM, AND PHOTOGRAPHIC CARTRIDGE

FIELD OF THE INVENTION

The present invention relates to a method for preparing a photographic photosensitive film, a photographic photosensitive film obtained by the preparation method, and a photographic cartridge. More particularly, this invention relates to a preparation method for obtaining a photographic photosensitive film having excellent in-camera handleability, and to a photographic photosensitive film obtained by the preparation method.

BACKGROUND OF THE INVENTION

Triacetylcellulose (hereinafter referred to as "TAC") has hitherto been widely used as the supports of rolled silver halide photosensitive materials (hereinafter referred to as "photosensitive materials," "photographic photosensitive materials," "photographic films," or "photographic photosensitive films"). This is because photographic films employing a TAC support which have been curled in cartridges recover their uncurled state during processing. However, since TAC supports show insufficient recovery from curling, photographic films employing such supports arouse various troubles attributable to curling when fitted into cartridges slender than the cartridges currently used in 135 systems. Such troubles include uneven development and rear-end folding which occur within mini-lab automatic processors. In processing a film with a mini-lab automatic processor, only the front end of the film is fixed to a guide plate, with the strongly curled rear end part remaining unfixed. Because of this, the rear end part of a strongly curled photosensitive material is apt to curl up to cause uneven development attributable to insufficient developer supply or to result in rear-end folding when passing through the nip rollers disposed at the outlet of the drying step.

The TAC supports also have a problem that since they are insufficient in mechanical strength, in particular tear strength and flexural modulus, their thickness cannot be reduced to 115 μm or below. Due to the limitation in thickness, a reduction in cartridge size and an increase in the number of film frames in the current cartridges have not been attained with the TAC supports.

A technique for eliminating such problems is to heat a polyester support at a temperature not higher than the glass transition temperature of the support (BTA treatment) as described in JP-A-6-035118 (the term "JP-A" as used herein means an "unexamined published Japanese patent application"). (Hereinafter, a support or photosensitive material prepared by this method is referred to as a "BTA support" or "BTA photosensitive material.") Although this prior art method is effective in eliminating the problems described above, the BTA photosensitive material was found to be apt to arouse troubles when fitted into a camera. Most of the recent 135 system cameras are of the automatic film-loading type, in which the only procedure required is to put a film in the camera and the front end part of the film is automatically drawn out and wound around the wind-up shaft unlike the conventional hand-operated cameras in which the front end part of a film is manually wound around the wind-up shaft. When the photosensitive material described in the above-cited reference was housed in a 135 cartridge and the cartridge was put in such a camera to attempt automatic film-loading, this aroused a trouble that the front end part of the film did not wind around the wind-up shaft.

SUMMARY OF THE INVENTION

An object of the present invention is to provide a photographic photosensitive film having excellent in-camera handleability. Other objects of the present invention are to provide a photographic cartridge containing the photographic photosensitive film and to provide a film preparation method for obtaining the photographic photosensitive film.

These objects are accomplished with the following means.

(1) A method for preparing a photographic photosensitive film comprising a support having provided on at least one side of the support photographic constituent layers containing a photosensitive silver halide emulsion layer, which comprises subjecting a photographic photosensitive film to a front-end treatment such that the photographic photosensitive film has an outermost-lap curl value of from 45 $m^{-1}$ to 200 $m^{-1}$ as measured after the treated film is housed in a cartridge, with the emulsion layer side facing inward.

(2) The method for preparing a photographic photosensitive film of item (1) described above, wherein the photographic photosensitive film has an innermost-lap curl value of from 50 $m^{-1}$ to 180 $m^{-1}$ after being housed in a cartridge and then subjected to 24-hour core setting at 50° C.

(3) The method for preparing a photographic photosensitive film of item (1) or (2), wherein the front-end treatment is carried out by winding the film, with the emulsion layer side facing inward, and heat-treating the wound film at a temperature not lower than 30° C. and not higher than the melting point ($T_m$) of the support.

(4) The method for preparing a photographic photosensitive film of item (1), (2) or (3), wherein the heat treatment is carried out while the film is kept being wound around a roll having a diameter of from 3 mm to 300 mm.

(5) The method for preparing a photographic photosensitive film of item (1), wherein the front-end treatment is accomplished by a BTA elimination method in which only a front end part thereof having a length of from 5 mm to 300 mm is treated at a temperature not lower than the glass transition temperature ($T_g$) of the support and not higher than the $T_m$ thereof, before the film is wound into a cartridge to curl the film.

(6) The method for preparing a photographic photosensitive film of any one of items (1) to (5), wherein the support is composed of a polyester.

(7) The method for preparing a photographic photosensitive film of any one of items (1) to (5), wherein the polyester support has been heat-treated at a temperature not lower than 50° C. and not higher than the glass transition temperature of the support.

(8) The method for preparing a photographic photosensitive film of any one of items (1) to (7), wherein the polyester support consists substantially of poly (ethylene 2,6-naphthalate).

(9) A photographic photosensitive film comprising a support having provided on at least one side of the support photographic constituent layers containing a photosensitive silver halide emulsion layer, which is prepared by the method of any one of items (1) to (8).

(10) A photographic film cartridge containing housed therein a photographic photosensitive film of item (9) so that a front end part of the film is out of the cartridge over a length of from 1 cm to 50 cm.

(11) A photographic film cartridge of item (10), wherein the cartridge has an outer diameter of 15 to 30 mm, preferably from 18 to 27 mm.

As a result of intensive studies on the above-described in-camera film winding failure, the cause thereof was found to be as follows. Although photosensitive materials employing the conventional TAC support are apt to recover their uncurled state during processing, they are readily curled. Because of such properties, those photosensitive materials, when stored in cartridges, are curled, with the photosensitive-layer side facing inward. In the case where such a photographic film is drawn out of the cartridge within a camera, the front-end part thereof moves on while maintaining the form of an arc and precisely winds around the wind-up shaft, whereby automatic film loading is conducted smoothly.

On the other hand, in the case of a cartridge containing the photosensitive material described in JP-A-6-035118, i.e., a BTA photosensitive material, the photosensitive material drawn out of the cartridge is in an almost uncurled state, or almost straight, because the photosensitive material is less apt to be curled unlike TAC photosensitive materials. If such a photographic film is drawn out within a camera, it is hardly wound around the wind-up shaft, causing winding failure troubles in automatic film-loading cameras.

Consequently, the problem concerning winding failure has been eliminated by producing a film which as a whole has the properties of BTA photosensitive materials and only a front end part of which is curled or is rendered apt to be curled. The film obtained by this method is characterized in that the rear end part thereof, which has been apt to be strongly curled to arouse troubles within a mini-lab processor, is less apt to be curled like ordinary BTA photosensitive materials, while the front end part thereof, which is fixed to a guide plate during processing in a mini-lab processor and is less apt to arouse troubles attributable to curling, is apt to be curled. This method can eliminate both in-camera winding troubles and development failures within mini-lab processors.

DETAILED DESCRIPTION OF THE INVENTION

The outermost-lap curl value imparted by the front-end treatment in the present invention is from 45 $m^{-1}$ to 200 $m^{-1}$, preferably from 60 $m^{-1}$ to 150 $m^{-1}$, more preferably from 70 $m^{-1}$ to 120 $m^{-1}$, in terms of the curl value as provided for in ANSI/ASC PH1.29-1985. If the outermost-lap curl value of a photographic film is lower than the lower limit, the film does not sufficiently wind around the wind-up shaft to cause a winding failure. If the curl value thereof is higher than the upper limit, the film curls without winding around the wind-up shaft, resulting also in a winding failure.

Preparation techniques used for obtaining photosensitive materials having such a curl value are divided roughly into the following two methods.

In the first method, only a front end part of a photosensitive material is deprived of the effect of a BTA treatment to render that part apt to be curled, whereby that end part is curled during storage. (This method is hereinafter referred to as "BTA elimination method.")

In the second method, a front end part of a photosensitive material is positively curled beforehand by winding that part around a thin rod or the like. (This method is hereinafter referred to as "out-of-roll curling method.")

The first method, i.e., "BTA elimination method," is intended to eliminate the effect of a BTA treatment only from a front end part. This is accomplished by exposing the front end part of the photographic film to a temperature not lower than the glass transition temperature ($T_g$) of the support for 1 second or longer. The temperature is preferably from the $T_g$ to the melting point ($T_m$) of the support, more preferably from ($T_g$+10° C.) to ($T_m$−20° C.). If a temperature lower than the lower limit is used, the BTA effect cannot be sufficiently eliminated. If a temperature higher than the upper limit is used, the front end part of the film is waved, resulting in impaired in-camera handleability. The treatment period is preferably from 3 seconds to 30 minutes, more preferably from 5 seconds to 10 minutes. Treatment periods shorter than the lower limit are undesirable in that the BTA effect cannot be sufficiently eliminated, while treatment periods longer than the upper limit are undesirable in that a reduced productivity results.

A preferred technique for carrying out the BTA elimination treatment is to bring a front end part of a film into direct contact with a heated table or roller to heat that part. Also usable are a technique of blowing hot air and a technique of using the radiation heat generated by a heat source (e.g., an infrared heater, halogen lamp, or nichrome wire). During the BTA elimination treatment, the part other than the front end part is preferably covered or cooled positively so as to prevent that other part from being deprived of the BTA effect.

The photographic photosensitive film whose front end part has thus undergone the BTA elimination treatment is housed in a cartridge to thereby curl the front end part. The temperature for this curling treatment is preferably from 15° C. to the $T_g$ of the support, more preferably from 20° C. to the temperature lower by 20° C. than the $T_g$ of the support, especially preferably from 23° C. to the temperature lower by 40° C. than the $T_g$ of the support. If a temperature lower than the lower limit is used, a front end part cannot be sufficiently curled. If a temperature higher than the upper limit is used, not only the BTA effect is eliminated from the whole photographic photosensitive material to arouse a winding trouble, but also the photosensitive layer is deteriorated to cause a decrease in image quality. The period for this curling treatment is preferably from 1 day to 3 years, more preferably from 3 days to 1 year, most preferably from 7 days to 3 months. Periods shorter than the lower limit are undesirable in that a front end part of the film cannot be sufficiently curled, while periods exceeding the upper limit are undesirable in that a reduced productivity results.

The second method, i.e., "out-of-roll curling method," is to wind a front end part of a photographic film around a member having a radius, with the photosensitive-layer side facing inward, to thereby positively curl the front end part. The member having a radius is preferably a sphere or a roll-form object, especially a roll-form object. The winding diameter of the front end part of the photographic film is preferably from 3 mm to 300 mm, more preferably from 5 mm to 200 mm, most preferably from 10 mm to 100 mm. If the winding diameter thereof is smaller than the lower limit, the front end part is curled too strongly. If the winding diameter thereof is larger than the upper limit, the front end part is curled insufficiently. In either case, the probability of in-camera winding troubles increases. The temperature for the treatment is preferably from 30° C. to the melting point ($T_m$) of the support, more preferably from 40° C. to ($T_m$−20° C.), most preferably from 50° C. to ($T_m$−50° C.). If a temperature lower than the lower limit is used, curling is insufficient. If a temperature higher than the upper limit is used, the photographic film is waved. In either case, the probability of winding troubles increases. The simplest method for heating a photographic photosensitive material to such a temperature is to preheat the roll around which the photosensitive material is to be wound. This can be attained by passing a heated gas (e.g., air or water vapor), a heated liquid (e.g., water or oil), or the like through a hollow roll, or by contacting a roll to a heat source having a constant temperature (e.g., a thermostatic bath). Alternatively, the roll may be heated by using a radiant heater (e.g., an infrared lamp or a nichrome wire) or blowing heated air or the like. Also usable is a method in which only a front end part of the photographic film is heated either with a radiant heater (e.g., an infrared lamp or a nichrome wire) or by passing that part through a heating medium (e.g., a heated table or rolls), before the film is wound around a roll. A combination of two or more of these methods is also preferably used.

The treatment period is preferably from 1 second to 1 hour, more preferably from 3 seconds to 30 minutes, most preferably from 5 seconds to 10 minutes. Periods shorter than the lower limit are undesirable in that curling is insufficient, while periods exceeding the upper limit are undesirable in that a reduced productivity results.

It is preferred that the "BTA elimination treatment" or "out-of-roll curling treatment" described above is preferably performed after a photosensitive layer and a back layer are provided and the resulting film has been subjected to slitting. Namely, the treatment may be performed before winding into a cartridge, or only a front end part of the photographic film which has been housed in a cartridge may be drawn out and subjected to the treatment. It is preferred that the photographic film which has undergone either of these treatments be cooled with a cooling medium (e.g., a cooling roll or cold air) before being wound, since the influence of the heat accumulated in that treated part on the photosensitive layer can be lessened.

Besides the two methods described above, any other method may be used for the front-end treatment in the present invention as long as the method used can impart the desired curling.

That part of a photographic film which is subjected to those treatments is in the part which will be out of a cartridge after the film is housed therein. The length of that front end part is preferably from 5 mm to 300 mm, more preferably from 10 mm to 150 mm, most preferably from 20 mm to 100 mm. If the length thereof is shorter than the lower limit, in-camera handleability cannot be sufficiently improved. If the length thereof exceeds the upper limit, the treated part reaches the frame region to cause a decrease in image quality.

The photographic film which undergoes any of those treatments may be any of a color negative photosensitive material, a color reversal photosensitive material, and a B/W photosensitive material. The photosensitive material which has undergone the treatment according to the present invention may be in the 135 format provided for in ANSI PH 1.14-1976 or JIS K 7519-1982 or in the Brownie format or the format described in JP-A-6-175283. Preferred of these is the 135 format. This is because the 135 format is currently the most widely used format and is employed most frequently in automatic film-loading cameras, with which the present invention is concerned.

In photographic photosensitive films in this 135 format, a front end part thereof has been drawn out of the cartridge over a length of from 10 mm to 500 mm for the purpose of film drawing in automatic film-loading cameras. It is therefore desirable that the photographic photosensitive material which has undergone the treatment according to the present invention be housed in a cartridge so that a front end part thereof is out of the cartridge over a length of from 10 mm to 500 mm, preferably from 20 mm to 200 mm, especially preferably from 50 mm to 100 mm.

The photosensitive material employing a polyester support according the present invention can have a reduced thickness due to the high mechanical strength of the support. Specifically, the thickness of the polyester support can be reduced from 122 μm, equal to that of the current TAC supports, to 60 μm. Consequently, when the photosensitive material is housed in a cartridge in the 135 format, it can have up to 80 frames, although the maximum number of frames has been 39. Whichever number of frames is used, the present invention can be applied in the same manner.

This photographic photosensitive material, after having undergone a 24-hour heat treatment at 50° C. for curling in a cartridge (hereinafter referred to as "core setting"), has an innermost-lap curl value of from 50 $m^{-1}$ to 180 $m^{-1}$, preferably from 65 $m^{-1}$ to 160 $m^{-1}$, more preferably from 80 $m^{-1}$ to 150 $m^{-1}$. Innermost-lap curl values exceeding the upper limit may cause troubles in a mini-lab processor such as "rear-end folding" and "uneven development". On the other hand, innermost-lap curl values lower than the lower limit are undesirable in that much time is required for a BTA treatment (heat treatment for rendering a film less apt to be curled; described below in detail) for obtaining such a low curl value.

A curl value within the above-specified range can be attained by heating the support at a temperature of from 50° C. to the glass transition temperature ($T_g$) of the support, preferably from 60° C. to ($T_g$−2° C.), more preferably from 70° C. to ($T_g$−5° C.). (This treatment is hereinafter referred to as "BTA treatment.")

The BTA treatment may be carried out at a constant temperature (constant-temperature BTA method). The treatment period in this case is generally from 5 minutes to 1,500 hours, preferably from 10 minutes to 500 hours, more preferably from 30 minutes to 200 hours.

The heat treatment may also be conducted while gradually cooling the support from the $T_g$ thereof (slow-cooling BTA method). A preferred method is to gradually cool the support from a temperature not lower than the $T_g$ thereof to a temperature below the $T_g$. The average rate of cooling in this case is preferably from −0.001° C./min to −100° C./min, more preferably from −0.001° C./min to −10° C./min, most preferably from −0.001° C./min to −1° C./min. It is also preferred to use a combination of this method and the constant-temperature BTA method described above.

Prior to these BTA treatments, "pre-BTA heat treatment" may be conducted at a temperature of from the $T_g$ to ($T_g$+130° C.), preferably from ($T_g$+20° C.) to ($T_g$+110° C.), more preferably from ($T_g$+30° C.) to ($T_g$+90° C.). The pre-BTA heat treatment is intended to completely destroy the thermal history of the polyester support to render the support susceptible to the BTA treatment. Because of this, the heat treatment should be conducted at a temperature not lower than the $T_g$. On the other hand, if the heat treatment is conducted at a temperature higher than ($T_g$+130° C.), the base generally comes to have enhanced flowability to pose a problem concerning handleability. The heat treatment is therefore preferably conducted a temperature within the above-specified range. The period for the pre-BTA heat treatment is from 0.1 minute to 1,500 hours, preferably from 0.2 minutes to 100 hours, more preferably from 0.3 minutes to 1 hour. Heat treatment periods longer than the upper limit are undesirable in that coloration of the base is caused. If the period for the heat treatment is shorter than the lower limit, the effect of imparting susceptibility to the BTA treatment cannot be sufficiently exhibited.

When the support which has undergone the BTA treatment or undergone the pre-BTA heat treatment and the subsequent BTA treatment is examined with a differential scanning calorimeter (DSC), it gives an endothermic peak having the maximum value in the range of from ($T_g$−20° C.) to ($T_g$+80° C.). The larger the area of this endothermic peak (endotherm), the less the support is curled.

The support preferably has a n endotherm of from 100 mcal/g to 1,000 mcal/g, when a 10-mg sample thereof is analyzed with a DSC in a nitrogen stream at a heating rate of 20° C./min. If the endotherm thereof is smaller than the lower limit, the support cannot be sufficiently curled. Even if the endotherm thereof is increased beyond the upper limit, the effect of reducing susceptibility to curling cannot be enhanced any more. The endotherm of the support is preferably from 150 mcal/g to 500 mcal/g, especially preferably from 200 mcal/g to 400 mcal/g.

In the BTA treatment o r the pre-BTA heat treatment, the support may be in a rolled state or in the form of a web which is traveling. For conducting the heat treatment of the rolled support, use may be made either of a method in which the roll is heat-treated from room temperature to the temperature of a thermostatic chamber, namely, a roll having room temperature is placed in a thermostatic chamber and heated to the predetermined temperature (hereinafter referred to as "low-temperature wind-up method") and a method in which a web heated to a predetermined temperature during traveling is wound up into a roll (hereinafter referred to as "high-temperature wind-up method"). The former method has an advantage of low equipment cost, although heating and cooling are time-consuming. On the other hand, the latter method has an advantage of no need for heating time, although equipment for winding up the web at a high temperature is necessary.

However, the heat-treatment of the rolled support has a drawback that due to the thermal shrinkage stress generated during the heat treatment, flatness troubles occur such as wrinkles resulting from roll tightening and defects caused by the cut edges of the core. On the other hand, the heat treatment of the web-form support necessitates heat treatment equipment having a considerable length in order to achieve a sufficient effect of the heat treatment. Although the two methods each has both advantages and disadvantages as described above, the present invention is effective in either method.

In the case where the support is wound around a roll before being heat-treated, the support is wound initially at a tension per unit roll width of preferably from 3 to 75 kg/m, more preferably from 10 to 40 kg/m, most preferably from 12 to 30 kg/m, and finally at a tension of preferably from 3 to 75 kg/m, more preferably from 5 to 35 kg/m, most preferably from 7 to 30 kg/m. If the tension for initial or final winding is lower than the lower limit, the roll is apt to become loose due to its own weight to cause deformation. If the winding tension exceeds the upper limit, wrinkles are apt to result due to roll tightening. It is preferred that the tension for initial winding be higher than that for final winding. The support is preferably wound so that the side where a back layer is to be formed faces inward.

The core around which the support is wound has a diameter of generally from 50 mm to 2,000 mm, preferably from 100 mm to 1,000 mm, more preferably from 150 mm to 600 mm. If the diameter thereof exceeds the upper limit, the core has poor handleability in, e.g., transporting. On the other hand, if the diameter thereof is smaller than the lower limit, the support should be wound in an increased number of turns and this tends to result in an increase in the thermal shrinkage stress imposed on the support close to the core to cause impaired flatness.

Although the material of the core for use in the heat treatment of the rolled support is not particularly limited, it is preferably a material which undergoes neither a decrease in strength nor deformation upon heating. Examples of such materials include stainless steel, aluminum, and resins containing glass fibers. If desired and necessary, the core may be covered with a rubber or a resin. In order for the core to more efficiently transfer heat to the film, the core may be hollow, may contain a built-in electric heater, or may have such a structure that a high-temperature liquid can pass therethrough.

The heat treatment may be performed at any stage from film formation to the formation of a photosensitive layer. It is however preferred to conduct the heat treatment after a surface treatment and before subbing for a photosensitive layer.

Supports made of various materials can be used in the present invention. Although various materials conventionally used as supports can be used, polyesters are most desirable.

A polyester support for use in the present invention is explained below in detail.

The polyester support of the present invention is preferably made of an aromatic polyester excellent in mechanical properties and heat resistance. Although polyesters are generally produced from diols and dicarboxylic acids as essential ingredients, the term aromatic polyester herein means a polyester obtained using a dicarboxylic acid ingredient which comprises an aromatic dicarboxylic acid as the main component and optionally further contains an aliphatic dicarboxylic acid and an alicyclic dicarboxylic acid. Examples of usable aromatic, aliphatic, and alicyclic dicarboxylic acids include terephthalic acid, isophthalic acid, phthalic acid, phthalic anhydride, naphthalenedicarboxylic acids (2,6-, 1,5-, 1,4-, and 2,7-), 3-sulfoisophthalic acid salts, sulfonaphthalenedicarboxylic acid salts, anthracenedicarboxylic acid, diphenylene-p,p'-dicarboxylic acid, diphenyl etherdicarboxylic acid, tetrachlorophthalic anhydride, succinic acid, glutaric acid, adipic acid, sebacic acid, succinic anhydride, maleic acid, fumaric acid, maleic anhydride, itaconic acid, citraconic anhydride, tetrahydrophthalic anhydride, 3,6-endomethylenetetrahydrophthalic anhydride, 1,4-cyclohexanedicarboxylic acid, halogenoterephthalic acids, bis(p-carboxyphenol) ether, 1,1-dicarboxy-2-phenylethylene, 1,4-dicarboxymethylphenol, and 1,3-dicarboxy-5-phenylphenol.

Examples of usable diols include ethylene glycol, 1,3-propanediol, 1,2-propanediol, 1,4-butanediol, 1,5-pentanediol, 1,6-hexanediol, 1,7-heptanediol, 1,8-octanediol, 1,10-decanediol, 1,12-dodecanediol, 1,4-cyclohexanediol, 1,4-cyclohexanedimethanol, 1,3-cyclohexanediol, 1,1-cyclohexanedimethanol, catechol, resorcinol, hydroquinone, 1,4-benzenedimethanol, dimethylolnaphthalene, p-hydroxyethyloxybenzene, bisphenol A, and 2,2-bis(4-hydroxyphenylpropane).

Preferred examples of the aromatic dicarboxylic acid include naphthalenedicarboxylic acids (2,6-, 1,5-, 1,4-, and 2,7-), terephthalic acid (TPA), isophthalic acid (IPA), o-phthalic acid (OPA), p-phenylenedicarboxylic acid (PPDC), sodium sulfoisophthalate (SSIA), and sodium sulfonaphthalenedicarboxylate (SNDC), with 2,6-naphthalenedicarboxylic acid (2,6-NDCA) being especially preferred.

The polyester preferably has a content of naphthalenedicarboxylic acid units based on all dicarboxylic acid residues of 30 mol % or higher, more preferably 50 mol % or higher, most preferably 85 mol % or higher.

Preferred examples of the diol include ethylene glycol (EG), polyethylene glycol (PEG), cyclohexanedimethanol (CHDM), neopentyl glycol (NPG), bisphenol A (BPA), and biphenol (BP), with ethylene glycol being especially preferred.

The polyester preferably has an intrinsic viscosity ($\eta$) (corresponding to molecular weight) as measured in 35° C. o-chlorophenol (g/dl) of from 0.35 to 1.00, more preferably from 0.4 to 0.8.

Of the polyesters produced from the monomers enumerated above, the most desirable polymer from the standpoints of mechanical strength and insusceptibility to curling is polyethylene 2,6-naphthalenedicarboxylate (PEN).

Preferred examples of the polyester for use in the present invention are shown below, but these compounds should not be construed as limiting the scope of the invention.

| Polyester Homopolymer Example | |
|---|---|
| P-1: poly(ethylene naphthalate) (PEN) (2,6-naphthalenedicarboxylic acid (NDCA)/ethylene glycol (EG) (100/100)) (PEN) | $T_g$ = 119° C., [$\eta$] = 0.55 |
| **Polyester Copolymer Examples (the numerals in each parenthesis indicate molar ratio)** | |
| P-2: 2,6-NDCA/TPA/EG (50/50/100) | $T_g$ = 92° C., [$\eta$] = 0.60 |
| P-3: 2,6-NDCA/TPA/EG (75/25/100) | $T_g$ = 102° C., [$\eta$] = 0.63 |
| P-4: 2,6-NDCA/TPA/EG/BPA (50/50/75/25) | $T_g$ = 112° C., [$\eta$] = 0.58 |
| P-5: 2,6-NDCA/EG/BPA (100/50/50) | $T_g$ = 155° C., [$\eta$] = 0.58 |
| P-6: 2,6-NDCA/EG/BPA (100/25/75) | $T_g$ = 155° C., [$\eta$] = 0.73 |
| P-7: 2,6-NDCA/EG/CHDM/BPA (100/25/25/50) | $T_g$ = 150° C., [$\eta$] = 0.48 |
| P-8: 2,6-SNDC/2,6-NDCA/EG/PEG (average molecular weight, 1,000) (10/90/80/20) | $T_g$ = 95° C., [$\eta$] = 0.80 |
| P-9: 2,6-NDCA/NPG/EG (100/70/30) | $T_g$ = 145° C., [$\eta$] = 0.58 |
| P-10: 2,6-NDCA/EG/BP (100/20/80) | $T_g$ = 130° C., [$\eta$] = 0.61 |
| P-11: PHBA/EG/2,6-NDCA (200/100/100) | $T_g$ = 150° C., [$\eta$] = 0.45 |
| **Polyester Polymer Blend Examples (the numerals in each parenthesis indicate weight ratio)** | |
| P-12: PEN/PET (60/40) | $T_g$ = 95° C. |
| P-13: PEN/PET (80/20) | $T_g$ = 104° C. |
| P-14: PAr/PEN (50/50) | $T_g$ = 142° C. |
| P-15: PAr/PCT/PEN (10/10/80) | $T_g$ = 135° C. |
| P-16: PAr/PC/PEN (10/10/80) | $T_g$ = 140° C. |
| P-17: PEN/PET/PAr (50/25/25) | $T_g$ = 108° C. |

These homopolymers and copolymers can be synthesized by conventionally known processes for polyester production. For example, an acid ingredient may be directly esterified with a glycol ingredient (direct polymerization method). Alternatively, use may be made of a method in which a dialkyl ester (preferably a dimethyl or diethyl ester) as an acid ingredient is reacted by transesterification with a glycol ingredient and the resulting reaction mixture is heated under vacuum to remove the excess glycol ingredient (transesterification method). It is also possible to react an acid halide as an acid ingredient with a glycol. The transesterification method is preferred.

For these polymerizations, a transesterification catalyst or a polymerization catalyst may be used if desired and necessary. A heat stabilizer (e.g., phosphorous acid, phosphoric acid, trimethyl phosphate, triethyl phosphate, or tetraethyl ammonium) may also be optionally added during the polymerizations.

An ultraviolet absorber may be added to those homopolymers and copolymers for the purpose of imparting long-term stability. Ultraviolet absorbers having no absorption within the visible region are desirable, and the addition amount thereof is usually from 0.5 to 20% by weight, preferably from about 1 to 10% by weight, based on the amount of the polymer film. If the addition amount thereof is smaller than 0.5% by weight, the effect of inhibiting ultraviolet deterioration cannot be expected. Examples of ultraviolet absorbers include benzophenone compounds such as 2,4-dihydroxybenzophenone, 2-hydroxy-4-methoxybenzophenone, 2-hydroxy- 4-n-octoxybenzophenone, 4-dodecyloxy-2-hydroxybenzophenone, 2,2',4,4'-tetrahydroxybenzophenone, and 2,2'-dihydroxy-4,4'-dimethoxybenzophenone; benzotriazole compounds such as 2-(2'-hydroxy-5-methylphenyl)benzotriazole, 2-(2'-hydroxy-3',5'-di-t-butylphenyl)benzotriazole, and 2-(2'-hydroxy-3'-di-t-butyl-5'-methylphenyl)benzotriazole; and salicylic acid compounds such as phenyl salicylate and methyl salicylate.

It is noted that use of an aromatic polyester as a film base may result in the so-called light-piping phenomenon (edge fogging) when light enters through a film edge and is reflected by the base/emulsion layer interface. This is because aromatic polyesters have a refractive index as high as from 1.6 to 1.7, while gelatin, which is the main component of the photosensitive layer formed on the base, has a lower refractive index of from 1.50 to 1.55.

Known techniques for avoiding such light-piping phenomenon include incorporation of inert inorganic particles or the like into the film and addition of a dye. The addition of a dye is desirable in that this does not significantly increase the film haze.

Dyes for use in film dyeing preferably have a gray tone from the standpoint of general properties of the photosensitive material, and preferably have excellent heat resistance in the temperature range where the polyester is formed into a film and excellent compatibility with the polyester.

The above purposes can be achieved with a mixture of commercial dyes for polyesters. Examples of such dyes include Diaresin, manufactured by Mitsubishi Chemical Industries Ltd., Japan, and Kayaset, manufactured by Nippon Kayaku Co., Ltd., Japan. The dyes described in Japanese Patent Application No. 5-050806 are preferred especially from the standpoint of thermal stability.

Slipping properties may be imparted to the polyester film for use in the present invention according to uses. Generally employed techniques for imparting slipping properties include the addition of an inert inorganic compound during kneading and the coating of the film with a surfactant.

Examples of such particulate inert inorganic materials include $SiO_2$, $TiO_2$, $BaSO_4$, $CaCO_3$, talc, and kaolin. Besides the aforementioned external impartation of slipping properties by adding inert particles to the reaction system for polyester synthesis, an internal impartation method can be used in which a catalyst or another ingredient added during the polymerization reaction for polyester production is precipitated as particles to impart slipping properties. The particles added externally are preferably $SiO_2$ particles, which have a refractive index relatively close to that of the polyester film. The particles internally precipitated preferably have a relatively small particle diameter.

A method of laminating layers having a function of enhancing film transparency is preferably used. For example, use may be made of the coextrusion method in which two or more extruders are used in combination with a feed block or a multi-manifold die.

In synthesizing those polyesters, reference may be made, for example, to Kōbunshi Jikken-gaku (Polymer Experiment), Vol. 5, "Jūshukugō To Jūfuka (Polycondensation and Polyaddition)" (Kyoritsu Shuppan, 1980), pp. 103–136; Gōsei Kōbunshi V (Synthetic Polymer V) (Asakura Shoten, 1971), pp. 187–286; and JP-A-5-163337, JP-A-3-179052, JP-A-2-3420, JP-A-1-275628, JP-A-62-290722, and JP-A-61-241316.

The polymers thus produced preferably have an intrinsic viscosity as measured in o-chlorophenol solvent at 35° C. of from 0.40 to 0.9, more preferably from 0.45 to 0.70.

In order for those polyesters to have improved adhesion to another kind of polyester, they may be blended with the different kind of polyester, or may be modified by the copolymerization of a monomer for use in producing the different kind of polyester. Alternatively, a monomer having an unsaturated bond may be copolymerized with those polyesters to radical-crosslink the same.

A polymer blend comprising a mixture of two or more of the polymers obtained can be easily produced according to the polymer blending methods described in JP-A-49-5482, JP-A-64-4325, JP-A-3-192718, Research Disclosure 283, 739-41, Research Disclosure 284,779-82, and Research Disclosure 294,807-14.

It is preferred to use the polyesters having a glass transition temperature ($T_g$) of from 70° C. to 200° C., more preferably from 90° C. to 190° C., most preferably from 100° C. to 180° C. The maximum temperature to which the photographic photosensitive film of the present invention is exposed is generally 65° C., which corresponds to the temperature at which photographic films can be sold in stores in summer. Consequently, the $T_g$ of the support should be higher than that temperature. Further, there are cases where the photographic film is exposed to the severest conditions when placed in a car parked outdoors in midsummer. In extreme cases, the temperature of the photographic film can reach 80° C. or higher. Therefore, the $T_g$ of the support is preferably 90° C. or higher. In this connection, a general-purpose transparent polyester having a $T_g$ exceeding 200° C. has not been developed.

Surface treatments of the support for use in the present invention are then described.

Effective in tenaciously adhering photographic layers (e.g., a photosensitive silver halide emulsion layer, interlayer, filter layer, and electrically conductive layer) to a support made of the polyester derivative of the invention are a method in which the support is subjected to a surface activation treatment, e.g., chemical treatment, mechanical treatment, corona treatment, flame treatment, ultraviolet treatment, high-frequency treatment, glow treatment, active-plasma treatment, laser treatment, mixed-acid treatment, or ozone oxidation treatment, before a photographic layer is directly formed thereon, and a method which comprises performing any of these surface treatments, subsequently forming a subbing layer, and then forming a photographic emulsion layer thereon. (See, for example, U.S. Pat. Nos. 2,698,241, 2,764,520, 2,864,755, 3,462,335, 3,475,193, 3,143,421, 3,501,301, 3,460,944, and 3,674,531, British Patents 788,365, 804,005, and 891,469, JP-B-48-43122, and JP-B-51-446.) (The term "JP-B" as used herein means an "examined Japanese patent publication.")

As the surface treatment, corona treatment, ultraviolet treatment, glow treatment, and flame treatment are more effective, and glow treatment is most effective.

Corona treatment, which is one of the most well known techniques, can be carried out by any of the conventionally known methods for corona treatment disclosed in, e.g., JP-B-48-5043, JP-B-47-51905, JP-A-47-28067, JP-A-49-83767, JP-A-51-41770, and JP-A-51-131576. The discharge frequency is preferably from 50 Hz to 5,000 kHz, more preferably from 5 kHz to several hundreds of kilohertz. Too low discharge frequencies are undesirable in that stable discharge cannot be obtained and the support being treated develops pinholes. Too high frequencies are undesirable in that a special apparatus for impedance matching is necessary, resulting in an increased equipment cost. The intensity of the corona discharge with which the support is treated is preferably from 0.001 $kV \cdot A \cdot min/m^2$ to 5 $kV \cdot A \cdot min\ m^2$, more preferably from 0.01 $kV \cdot A \cdot min/m^2$ to 1 $kV \cdot A \cdot min/m^2$, from the standpoint of improving the wettability of ordinary polyester derivatives. The gap clearance between the electrode and the dielectric roll is preferably from 0.5 to 2.5 mm, more preferably from 1.0 to 2.0 mm.

For example, in the case of using solid-state corona treatment device Model 6KVA manufactured by Pillar Co., the discharge frequency during treatment is preferably from 5 to 40 kHz, more preferably from 10 to 30 kHz. The waveform is preferably an alternating sine wave. The gap clearance between the electrode and the dielectric roll is preferably from 1 to 2 mm, more preferably from 1.4 to 1.6 mm. The amount of the corona discharge used for treatment is preferably from 0.3 to 0.4 $kV \cdot A \cdot min/m^2$, more preferably from 0.34 to 0.38 $kV \cdot A \cdot min/m^2$.

Ultraviolet treatment can be carried out according to U.S. Pat. No. 5,326,689. Ultraviolet treatment is preferably performed during a film formation process (in the step of stretching or heat setting or after the step of heat setting), particularly during the latter half of the stretching step or during heat setting. In particular, ultraviolet treatment conducted during heat setting is advantageous in that since the film, during irradiation with ultraviolet, has a temperature as high as 150° to 250° C., the irradiation period necessary for achieving the desired effect can be from ½ to ⅔ of that for irradiation after heat setting.

With respect to methods for ultraviolet irradiation, the dose is preferably from 20 to 10,000 ($mJ/cm^2$), more preferably from 50 to 2,000 ($mJ/cm^2$), in the case of using a high-pressure mercury lamp having a main wavelength of 365 nm, and is preferably from 100 to 10,000 ($mJ/cm^2$), more preferably from 200 to 1,500 ($mJ/cm^2$) in the case of using a low-pressure mercury lamp having a main wavelength of 254 nm.

Glow treatment can be carried out according to U.S. Pat. No. 5,407,791.

When glow treatment is conducted in an atmosphere containing water vapor, the highest adhesion-enhancing effect can be obtained. This technique is exceedingly effective also in inhibiting the substrate from yellowing or suffering blocking.

The partial pressure of water vapor in glow treatment conducted in the presence of water vapor is preferably from 10% to 100%, more preferably from 40% to 90%. If the partial presence thereof is lower than 10%, it is difficult to obtain sufficient adhesiveness. The gas other than the water vapor may be air, composed of oxygen, nitrogen, etc.

For introducing water vapor at a constant rate into the atmosphere for glow discharge treatment, use may be made of a method in which the treatment is conducted while sampling the atmospheric gas and introducing the same into a quadripole mass spectrometer (MSQ-150, manufactured by ULVAC Corp., Japan) through a sampling tube attached to the glow discharge apparatus to determine the composition of the gas.

When glow treatment is conducted under vacuum while heating the support, adhesiveness can be improved in a shorter treatment time and the yellowing of the support can be considerably reduced, as compared with treatment at ordinary temperature. This preheating differs from the heat treatment for curling improvement as described above.

The preheating temperature is preferably from 50° C. to the $T_g$, more preferably from 70° C. to the $T_g$, most preferably from 90° C. to the $T_g$. If the support is preheated to a temperature higher than the $T_g$ thereof, poor adhesion results.

Examples of methods for elevating the temperature of the support surface in a vacuum include heating with an infrared heater and heating by contact with a heated roll. Any of various known heating methods may be used.

The glow treatment is preferably conducted using two or more electrodes which each has a hollow part serving as a coolant passageway and are arranged face-to-face along a film width direction, while keeping the support traveling.

The degree of vacuum during the glow treatment is preferably from 0.005 to 20 Torr, more preferably from 0.02 to 2 Torr. If the pressure is too low, the support surface cannot be sufficiently modified, so that sufficient adhesiveness cannot be obtained. On the other hand, if the pressure is too high, stable discharge does not occur.

The voltage is preferably from 500 to 5,000 V, more preferably from 500 to 3,000 V. If the voltage is too low, the support surface cannot be sufficiently modified, so that sufficient adhesiveness cannot be obtained. On the other hand, if the voltage is too high, the surface is denatured, resulting in reduced adhesiveness, far from an improvement.

As in prior art glow discharge techniques, the discharge frequency to be used varies from direct current to several thousands of megahertz, preferably from 50 Hz to 20 MHz, more preferably from 1 kHz to 1 MHz.

The intensity of the glow discharge used for the treatment for obtaining the desired adhesive performance is preferably from 0.01 kV·A·min/m$^2$ to 5 kV·A·min/m$^2$, more preferably from 0.15 kV·A·min/m$^2$ to 1 kV·A·min/m$^2$.

The support which has thus undergone glow treatment is preferably cooled immediately thereafter with a cooling roll. This is because the support, with increasing temperature, comes to readily undergo plastic deformation upon application of an external force, resulting in impaired flatness of the support treated. In addition, there is the possibility that low-molecular components (monomers, oligomers, etc.) might migrate to the support surface to impair transparency and nonblocking properties.

Flame treatment may be conducted using either a natural gas or liquefied propane gas. However, the gas/air mixing ratio is important. In the case of propane gas, the gas/air mixing ratio is preferably from 1/14 to 1/22, more preferably from 1/16 to 1/19, by volume. In the case of a natural gas, the gas/air mixing ratio is preferably from 1/6 to 1/10, more preferably from 1/7 to 1/9.

It is desirable to conduct the flame treatment in the range of from 1 to 50 kcal/m$^2$, more preferably from 3 to 30 kcal/m$^2$. A higher effect is obtained when the distance between the support and the tips of the inner burner flames is regulated to below 4 cm. For the flame treatment, a flame treatment apparatus manufactured by Kasuga Denki Co., Ltd., Japan can be used. It is preferred that hollow back-up rolls cooled by passing cooling water therethrough be used for supporting the support during the flame treatment to thereby carry out the treatment at a constant temperature.

An antistatic layer is preferably formed on the support. Antistatic agents for use in forming the antistatic layer are not particularly limited, and may be electrically conductive antistatic agents or compounds which function to control static property.

Examples of the electrically conductive antistatic agents include metal oxides and ionic compounds. Preferably used in the present invention are electrically conductive antistatic agents which retain their intact antistatic properties after processing. Examples of such antistatic agents include electrically conductive metal oxides and derivatives thereof, electrically conductive metals, carbon fibers, and π-conjugated polymers (e.g., polyarylenevinylenes), with particles of crystalline metal oxides being more preferred.

Most preferred examples of the particulate electrically conductive metal oxides include fine particles of at least one crystalline metal oxide selected from ZnO, $TiO_2$, $SnO_2$, $Al_2O_3$, $In_2O_3$, $SiO_2$, MgO, BaO, $MoO_3$, and $V_2O_5$ or of mixed oxides thereof, and especially preferred examples include a mixed oxide which comprises $SnO_2$ as the main component and about 5 to 20% antimony oxide and may optionally further contain other ingredients (e.g., silicon oxide, boron, and phosphorus). The fine particles of these electrically conductive crystalline oxides or mixed oxides thereof have a volume resistivity of $10^7$ Ω·cm or lower, preferably 106 Ω·cm or lower, more preferably $10^5$ Ω·cm or lower. If the volume resistivity thereof is higher than the upper limit, antistatic property cannot be sufficiently exhibited. The fine particles preferably have a particle size of from 0.002 to 0.7 μm, more preferably from 0.005 to 0.3 μm. Fine particles of those crystalline metal oxides or of mixed oxides thereof are described in detail in JP-A-56-143430 and JP-A-60-258541.

Such an electrically conductive metal oxide may be applied as a coating fluid containing no binder. The coated amount of the electrically conductive metal oxide is generally 1 g/m$^2$ or lower, preferably from 0.001 to 0.5 g/m$^2$, more preferably from 0.005 to 0.3 g/m$^2$, and most preferably from 0.01 to 0.3 g/m$^2$. In this case, a binder is preferably applied on the resulting metal oxide coating.

It is preferred to apply the electrically conductive metal oxide of the present invention together with a binder. In this case, the coated amount of the metal oxide is generally 1 g/m$^2$ or lower, preferably from 0.001 to 0.5 g/m$^2$, more preferably from 0.005 to 0.5 g/m$^2$, and most preferably from 0.01 to 0.3 g m$^2$. The coated amount of the binder is preferably from 0.001 to 2 g/m$^2$, more preferably from 0.005 to 1 g/m$^2$, most preferably from 0.01 to 0.5 g/m$^2$. In this case, the weight ratio of the metal oxide to the binder is preferably from 1,000/1 to 1/1,000, more preferably from 500/1 to 1/500, most preferably from 250/1 to 1/250. A mixture of spherical metal oxide particles and a fibrous metal oxide may be used.

An ionic electrically conductive polymer or latex may also be used. The ionic electrically conductive polymer to be used is not particular limited, and may be any of anionic, cationic, betaine type, and nonionic polymers. Anionic and cationic polymers are preferred, and anionic polymers such as sulfonic, carboxylic, and phosphoric acid type polymers or latexes and tertiary amine, quaternary ammonium, and phosphonium type polymers are more preferred. Examples of these electrically conductive polymers include the anionic polymers or latexes described in JP-A-48-22017, JP-B-46-24159, JP-A-51-30725, JP-A-51-129216, JP-A-55-95942, JP-B-52-25251, JP-A-51-29923, and JP-B-60-48024 and the cationic polymers or latexes described in JP-A-48-91165, JP-A-49-121523, JP-B-49-24582, JP-B-57-18176, JP-B-57-56059, JP-B-58-56856, and U.S. Pat. No. 4,118,231.

These electrically conductive polymers or latexes may be applied as a coating fluid containing no binder. In this case, a binder is preferably applied on the resulting electrically conductive coating. These electrically conductive polymers or latexes may also be applied together with a binder.

The content of such an electrically conductive polymer or latex is generally from 0.005 to 5 g/m$^2$, preferably from 0.01 to 3 g/m$^2$, more preferably from 0.02 to 1 g/m$^2$. The binder content is generally from 0.005 to 5 g/m$^2$, preferably from 0.01 to 3 g/m$^2$, more preferably from 0.01 to 2 g/m$^2$.

The weight ratio of the electrically conductive polymer or latex to the binder is generally from 100/1 to 10/100, preferably from 95/5 to 15/85, more preferably from 90/10 to 20/80.

The subbing layer formed between the surface-treated support and a photosensitive layer is then described. For forming a subbing layer, use may be made of the so-called multilayer method, in which a layer tenaciously adhering to the support is formed as a first layer (hereinafter referred to as a first subbing layer) and a layer tenaciously adhering to both the first subbing layer and a photographic layer is formed thereon as a second layer (hereinafter referred to as a second subbing layer), and the single-layer method in which a layer tenaciously adhering to both the support and a photographic layer is formed as the only layer.

In the multilayer method, the first subbing layer is formed using, for example, a copolymer of monomers selected from vinyl chloride, vinylidene chloride, butadiene, vinyl acetate, styrene, acrylonitrile, methacrylic esters, methacrylic acid, acrylic acid, itaconic acid, maleic anhydride, and the like, an epoxy resin, a gelatin, nitrocellulose, poly(vinyl acetate), or the like. (Details of these materials are described in, e.g., E. H. Immergut, *Polymer Handbook*, pp. 187–231, Interscience Pub., New York, 1966.) For forming the second subbing layer, a gelatin is mainly used.

In the single-layer method, the frequently employed technique for obtaining satisfactory adhesiveness is to swell the support to mix the support polymer and a subbing polymer at the interface. Examples of this subbing polymer include water-soluble polymers such as gelatins, gelatin derivatives, casein, agar, sodium alginate, starch, poly(vinyl alcohol), acrylic acid copolymers, and maleic anhydride copolymers; cellulose esters such as carboxymethyl cellulose and hydroxyethyl cellulose; and latex polymers such as vinyl chloride copolymers, vinylidene chloride copolymers, acrylic ester copolymers, and vinyl acetate copolymers. Gelatin is preferably used, and any kind of gelatins generally used in the art can be used. Examples thereof include the so-called limed gelatin, acid-treated gelatin, enzyme-treated gelatin, gelatin derivatives, and modified gelatins, with limed gelatin and acid-treated gelatin being most preferred. These gelatins may contain various impurities which came thereinto during the production thereof. The concentration of such impurities is, for example, from 0.01 to 20,000 ppm. Examples of such impurities include metals (such as Na, K, Li, Rb, Ca, Mg, Ba, Ce, Fe, Sn, Pb, Al, Si, Ti, Au, Ag, Zn, Ni, and ions thereof) and ions (such as F, Cl, Br, I, sulfate ion, nitrate ion, acetate ion, and ammonium ion). In particular, it is known in the art that limed gelatin contains Ca and Mg ions in an amount varying in an exceedingly wide range of from 10 to 3,000 ppm. However, the content of Ca and Mg ions in limed gelatin is preferably up to 1,000 ppm, more preferably up to 500 ppm, from the standpoint of performance of the subbing layer.

The synthetic hydrophilic compounds may be copolymers with other ingredients. However, copolymers having too high a content of hydrophobic comonomer units are undesirable from the standpoint of curling, because use of such a copolymer results in the formation of a photo-insensitive hydrophilic layer reduced in the capacity and rate of moisture absorption. Those hydrophilic compounds may be used alone or as a mixture of two or more thereof.

The subbing polymers can be hardened. Examples of the hardener include chromium salts (e.g., chrome alum), aldehydes (e.g., formaldehyde and glutaraldehyde), epoxy compounds, isocyanates, active halogen compounds (e.g., 2,4-dichloro-6-hydroxy-s-triazine), epichlorohydrin resins, polyamideepichlorohydrin resins (JP-B-49-26580 and JP-A-51-3619), cyanuric chloride compounds (described in, e.g., JP-A-47-6151, JP-A-47-33380, JP-A-54-25411, and JP-A-56-130740), vinyl sulfone or sulfonyl compounds (described in, e.g., JP-B-47-24259, JP-B-50-35807, JP-A-49-24435, JP-A-53-41221, and JP-A-59-18944), carbamoylammonium salt compounds (described in, e.g., JP-B-56-12853, JP-B-58-32699, JP-A-49-51945, JP-A-51-59625, and JP-A-61-9641), amidinium salt compounds (described in, e.g., JP-A-60-225148), carbodiimide compounds (described in, e.g., JP-A-51-126125 and JP-A-52-48311), pyridinium salt compounds (described in, e.g., JP-B-58-50699, JP-A-52-54427, JP-A-57-44140, and JP-A-57-46538), and the compounds described in, e.g., Belgian Patent 825,726, U.S. Pat. No. 3,321,313, JP-A-50-38540, JP-A-52-93470, JP-A-56-43353, and JP-A-58-113929.

Various additives may be incorporated into the subbing layer if desired and necessary. Examples thereof include surfactants, antistatic agents, halation inhibitors, dyes for coloring, pigments, coating aids, and antifoggants.

Fine particles of an inorganic or organic substance may be incorporated as a matting agent into the subbing layer to such an amount that the transparency and graininess of images are not substantially impair. Examples of finely particulate inorganic matting agents include silica ($SiO_2$), titanium dioxide ($TiO_2$), calcium carbonate, and magnesium carbonate.

Examples of finely particulate organic matting agents include poly(methyl methacrylate), cellulose acetate propionate, polystyrene, the material soluble in a processing solution as described in U.S. Pat. No. 4,142,894, and the polymer described in U.S. Pat. No. 4,396,706. The average particle diameter of these finely particulate matting agents are preferably from 0.01 to 10 μm, more preferably from 0.05 to 5 μm. The content thereof is preferably from 0.5 to 600 mg/m$^2$, more preferably from 1 to 400 mg/m$^2$.

Examples of compounds used for swelling the support include resorcinol, chlororesorcinol, o-cresol, m-cresol, p-cresol, phenol, o-chlorophenol, p-chlorophenol, dichlorophenol, trichlorophenol, monochloroacetic acid, dichloroacetic acid, trifluoroacetic acid, and chloral hydrate. Resorcinol and p-chlorophenol are preferred.

A subbing fluid can be applied by generally well known coating techniques such as, e.g., dip coating, air-knife coating, curtain coating, roller coating, wire-wound bar coating, gravure coating, and the extrusion coating technique using a hopper as described in U.S. Pat. No. 2,681,294. If desired and necessary, two or more layers may be formed by simultaneous coating by any of the methods described in, e.g., U.S. Pat. Nos. 2,761,791, 3,508,947, 2,941,898, and 3,526,528 and Yūji Harazaki, Kōtingu Kōgaku (Coating Engineering), p. 253 ((Asakura Shoten, 1973).

Such a subbing layer is preferably formed after the heat treatment according to the present invention. This is because since the subbing layer, which is a layer for imparting adhesiveness, mostly has tackiness, formation of the subbing layer at an early stage tends to result in enhanced creak value and this is apt to reduce the flatness of the heat-treated support.

In the present invention, the photosensitive material may have a photosensitive silver halide emulsion layer on both sides or on one side only. In the case where the photosensitive material has an emulsion layer on one side only, a back layer is preferably formed on the opposite side of the support. This back layer generally comprises two or more photographic constituent layers so as to perform various functions. Examples of such layers include an adhesive layer, antistatic layer, antimarring layer, slipping layer, antiblock layer, and anticurl layer. Further, a transparent magnetic recording layer such as those described in U.S. Pat. Nos. 3,782,947 and 4,279,945 may be formed.

These layers are not particularly limited in the sequence of layer arrangement and in the thickness thereof. If desired, two or more layers having the same function may be formed. The thickness of each layer is preferably from 0.0001 μm to 10 μm, more preferably from 0.001 μm to 5 μm. The total thickness of all back-side layers is preferably from 0.001 to 10 μm.

Although each back-side constituent layer may consist of functional material(s) only, the functional material is generally used together with a binder. This binder may be either a hydrophobic polymer or a hydrophilic polymer such as those for use in subbing layers, or may be a crosslinked polymer as a latex.

The functional layers as the back layer include an antistatic layer. This layer can be formed by the methods described above.

In the case of forming a slipping layer, examples of usable slipping agents include polyorganosiloxanes such as those disclosed in JP-B-53-292, higher fatty acid amides such as disclosed in U.S. Pat. No. 4,275,146, higher fatty acid esters (esters of fatty acids having 10 to 24 carbon atoms with alcohols having 10 to 24 carbon atoms) as disclosed in JP-B-58-33541, British Patent 927,446, JP-A-55-126238, and JP-A-58-90633, higher fatty acid metal salts as disclosed in U.S. Pat. No. 3,933,516, linear higher fatty acid/linear higher alcohol esters as disclosed in JP-A-58-50534, and higher fatty acid/higher alcohol esters containing a branched alkyl group as disclosed in International Publication WO 90108115.8.

Specific examples of the polyorganosiloxanes include the generally known polyalkylsiloxanes such as polydimethylsiloxane and polydiethylsiloxane and the generally known polyarylsiloxanes such as polydiphenylsiloxane and polymethylphenylsiloxane, and further include modified polysiloxanes including organopolysiloxanes having a $C_5$ or higher alkyl group such as described in, e.g., JP-B-53-292, JP-B-55-49294, and JP-A-60-140341, alkylpolysiloxanes having polyoxyalkylene side chains, and organopolysiloxanes having side chains containing an alkoxy, hydroxy, hydrogen, carboxyl, amino, or mercapto. Also usable are block copolymers containing siloxane units and graft copolymers having side chains comprising siloxane units as described in JP-A-60-191240.

Specific examples of the higher fatty acids, derivatives thereof, higher alcohols, and derivatives thereof include higher fatty acids, metal salts of higher fatty acids, higher fatty acid esters, higher fatty acid amides, higher fatty acid/polyhydric alcohol esters, higher aliphatic alcohols, mono-, di-, and trialkyl phosphites and mono-, di-, and trialkyl phosphates of higher aliphatic alcohols, higher aliphatic alkylsulfonic acids, and amides and salts of the sulfonic acids.

Of those compounds, the following long-chain alkyl compounds are preferred in that they enable the photosensitive material to have sufficient slipping properties and marring resistance both before and after processing.

| | |
|---|---|
| (S1-1) | $n\text{-}C_{15}H_{31}COOC_{30}H_{61}\text{-}n$ |
| (S1-2) | $n\text{-}C_{17}H_{35}COOC_{40}H_{81}\text{-}n$ |
| (S1-3) | $n\text{-}C_{13}H_{31}COOC_{50}H_{101}\text{-}n$ |
| (S1-4) | $n\text{-}C_{27}H_{43}COOC_{28}H_{57}\text{-}n$ |
| (S1-5) | $n\text{-}C_{21}H_{43}COOCH_2CH(CH_3)\text{-}C_9H_{19}$ |
| (S1-6) | $n\text{-}C_{21}H_{43}COOC_{24}H_{49}\text{-}iso$ |
| (S2-1) | $n\text{-}C_{29}H_{49}OCO(CH_2)_2COOC_{24}H_{49}\text{-}n$ |
| (S2-2) | $n\text{-}C_{18}H_{37}OCO(CH_2)_4COOC_{40}H_{81}\text{-}n$ |
| (S2-3) | $n\text{-}C_{18}H_{37}OCO(CH_2)_{18}COOC_{18}H_{37}\text{-}n$ |
| (S2-4) | $iso\text{-}C_{24}H_{49}OCO(CH_2)_4COOC_{24}H_{49}\text{-}n$ |
| (S2-5) | $n\text{-}C_{40}H_{81}OCO(CH_2)_2COOC_{50}H_{101}\text{-}n$ |
| (S2-6) | $n\text{-}C_{17}H_{35}COO(CH_2)_6OCOC_{17}H_{35}\text{-}n$ |
| (S2-7) | $n\text{-}C_{21}H_{43}COO(CH_2)_{18}OCOC_{21}H_{43}\text{-}n$ |
| (S2-8) | $iso\text{-}C_{23}H_{47}COO(CH_2)_2OCOC_{23}H_{47}\text{-}n$ |
| (S2-9) | $iso\text{-}C_{15}H_{31}COO(CH_2)_6OCOC_{21}H_{43}\text{-}n$ |
| (S3-1) | $HOCO(CH_2)_{10}COOC_{21}H_{43}$ |
| (S3-2) | $C_{17}H_{35}COOCH_2CH(OH)C_{12}H_{25}$ |
| (S3-3) | $C_9H_{19}C(OH)(C_9H_{19})CH_2COOC_{25}H_{51}$ |
| (S3-4) | $C_6H_{13}CH(OH)(CH_2)_{10}COOC_{40}H_{61}$ |
| (S3-5) | $C_{14}H_{29}CH(NH_2)COO(CH_2)_nCH(CH_3)\text{-}(CH_2)_mCH$ (n + m = 15) |
| (S3-6) | $CH_3(CH_2)_2CH(COONa)(CH_2)_6COOC_{40}H_{81}$ |
| (S3-7) | $HOCH_2(CH_2)_6CH(OH)CH(OH)(CH_2)_4COO\text{-}C_{50}H_{101}$ |
| (S3-8) | $C_{17}H_{33}COO(CH_2)_{16}OH$ |
| (S3-9) | $CH_3(CH_2)_2CH(OH)(CH_2)_6CONHC_{21}H_{42}$ |
| (S3-10) | $C_7H_{15}\text{-}\phi\text{-}COOCH(CONH_2)C_{16}H_{33}$ |
| (S3-11) | $C_{27}H_{55}COOCH_2CH(OH)CH_2OH$ |
| (S3-12) | $HOCO(CH_2)_5COOC_{40}H_{81}$ |
| (S3-13) | $CH_3(CH_2)_{15}CH(SO_3Na)COOCH_2CH(C_{13}H_{27})\text{-}C_{10}H_{21}$ |
| (S4-1) | $C_{14}H_{29}CHCOO(CH_2)_5OCOCH(OH)C_{14}H_{29}$ |
| (S4-2) | $C_{10}H_{21}COOCH(C_2H_5)(CH_2)_7CH(C_2H_4COOH)\text{-}OCOC_{10}H_{21}$ |
| (S4-3) | $NaOCO(CH_2)_{11}COO(CH_2)_{10}OCO(CH_2)_{11}\text{-}COOH$ |
| (S4-4) | $C_9H_{19}C(OH)(C_9H_{19})CH_2COO(CH_2)_{15}CONH\text{-}C_{10}H_{21}$ |
| (S4-5) | $H_2NCO(CH_2)_{10}COOCH(C_6H_{13})(CH_2)_{10}COO\text{-}C_{30}H_{61}$ |
| (S4-6) | $C_{14}H_{29}CH(N^+(CH_3)_4Cl^-)COO(CH_2)_{10}OCO\text{-}C_{17}H_{33}$ |
| (S4-7) | $C_6H_{13}CH(OH)(CH_2)_{10}COO(CH_2)_8OCO\text{-}(CH_2)_{10}CH(OH)C_6H_{13}$ |
| (S4-8) | $C_{15}H_{31}COOCH_2CH(OH)CH_2OCOC_{15}H_{31}$ |
| (S4-9) | $C_8H_{17}NHCO(CH_2)_{10}COO(CH_2)_{15}OH$ |
| (S4-10) | $C_{40}H_{81}OCO(CH_2)_5COO(CH_2)_5COOH$ |
| (S4-11) | $CH_3(CH_2)_{15}CH(SO_3Na)COO(CH_2)_2CH\text{-}(CH_3)(CH_2)_2OCOC_{17}H_{35}$ |
| (S4-12) | $HOCH_2CH(OH)CH_2OC(CH_2)_3CH(C_2H_5)\text{-}(CH_2)_9COOC_{50}H_{101}$ |

$\phi$: $—C_6H_4—$

Although the amount of the slipping agent is not particularly limited, the content thereof is preferably from 0.001 to 0.1 g/m$^2$, more preferably from 0.005 to 0.05 g/m$^2$, so as to impart sufficient slipping properties and marring resistance.

Many of those slipping agents have poor solubility in solvents because of their high hydrophobicity. Although such slipping agents may therefore be used by a technique of dissolving the same in a nonpolar organic solvent, e.g., toluene or xylene, or by a technique of dispersing the same into a coating fluid, the latter technique is preferred because nonpolar organic solvents are difficult to handle.

For dispersing a slipping agent, generally know emulsifying/dispersing methods can be used. Examples thereof include a method comprising dissolving the slipping agent into an organic solvent and emulsifying the solution into water; a method comprising melting the slipping agent at a high temperature and emulsifying the melt into water; and a method in which the slipping agent in its solid state is dispersed with a ball mill or a sand grinder. Such emulsifying/dispersing methods are described in, e.g., Karime, Koishi, and Hidaka, ed., Nyūka.Bunsan Gijutsu Ōyō Handobukku (Emulsifying/Dispersing Technology Application Handbook), (Science Forum).

The silver halide photographic photosensitive material of the present invention may have a magnetic recording layer such as that described in JP-A-6-059357, preferably on the back side of the support, so as to record various information. The magnetic recording layer can be formed by coating or printing. Further, a space for optically recording various information may be formed in the photosensitive material.

The photographic layers of the photographic photosensitive material of the present invention are then described.

The silver halide emulsion layer may be one for a color photosensitive material or one for a black-and-white photosensitive material. An explanation is made herein on a silver halide color-photographic photosensitive material.

The photosensitive material of the present invention is not particularly limited in the number of silver halide emulsion layers, the number of photo-insensitive layers, and the sequence of layer arrangement, as long as at least one silver halide emulsion layer selected from blue-sensitive layers, green-sensitive layers, and red-sensitive layers has been formed on the support. A representative example thereof is a silver halide photographic photosensitive material comprising a support and formed thereon at least one photosensitive layer composed of two or more silver halide emulsion layers which have substantially the same color sensitivity but differ in photographic sensitivity, the photosensitive layer being a unit photosensitive layer having sensitivity to any of blue light, green light, and red light. In a multilayered silver halide color-photographic photosensitive material, unit photosensitive layers are generally disposed so that a red-sensitive layer, a green-sensitive layer, and a blue-sensitive layer are arranged in this order from the support side. However, the above sequence of layer arrangement may be reversed according to purposes, or use may also be made of a layer arrangement in which a photosensitive layer is sandwiched between photosensitive layers having the same color sensitivity which is different from that of the sandwiched layer.

Photo-insensitive layers, e.g., an interlayer, may be formed between the above-described silver halide photosensitive layers, and a photo-insensitive uppermost or lowermost layer may also be formed.

Such interlayers may contain a coupler, DIR compound, and the like as described in JP-A-61-43748, JP-A-59-113438, JP-A-59-113440, JP-A-61-20037, and JP-A-61-20038, and may also contain an ordinary color mixing inhibitor.

The silver halide emulsion layers constituting each unit photosensitive layer are described in West German Patent 1,121,470, British Patent 923,045, JP-A-57-112751, JP-A-62-200350, JP-A-62-206541, JP-A-62-206543, JP-A-56-25738, JP-A-62-63936, JP-A-59-202464, JP-B-55-34932, and JP-B-49-15495.

The silver halide grains for use in the present invention may be grains having a regular crystal form such as cube, octahedron, or tetradecahedron or a irregular crystal form such as a spherical or tabular form, or may be grains having a crystal defect, e.g., a twin plane. The silver halide grains may also be a combination of these.

The grain diameter of the silver halide may vary from fine grains of about 0.2 μm or smaller to large grains with a projected-area diameter of about 10 μm. The emulsion may be either a polydisperse or a monodisperse emulsion.

Silver halide photographic emulsions that can be used in the present invention can be prepared, for example, by the methods described in *Research Disclosure* (RD), No. 17643 (December 1978), pp. 22–23 "I. Emulsion Preparation and Types"; RD, No. 18716 (Nov. 1979), p. 648; P. Glafkides, *Chemie et Phisique Photographique*, Paul Montel, 1967; G. F. Duffin, *Photographic Emulsion Chemistry*, Focal Press, 1966; and V. L. Zelikman, et al., *Making and Coating Photographic Emulsion*, Focal Press, 1964.

The monodisperse emulsions described in U.S. Pat. Nos. 3,574,628 and 3,655,394 and British Patent 1,413,748 are also preferred.

Tabular grains having an aspect ratio of about 5 or higher may be used in the present invention. Such tabular grains can be easily prepared by the methods described in Gutoff, *Photographic Science and Engineering*, Vol. 14, pp. 248–257 (1970), U.S. Pat. Nos. 4,434,226, 4,414,310, 4,433,048, and 4,439,520, and British Patent 2,112,157.

Each grain may have a homogeneous structure or a multilayer structure composed of an inner part and an outer part which parts differ in halogen composition. Each grain may be composed of silver halides having different compositions and bonded together through epitaxy, or may be composed of a silver halide and another compound, e.g., silver thiocyanate or lead oxide, bonded together through epitaxy.

Further, a mixture of grains having various crystal forms may be used.

The silver halide emulsion is usually subjected before use to physical ripening, chemical ripening, and spectral sensitization. The effect of the present invention is enhanced significantly especially when an emulsion which has been sensitized with a gold compound and a sulfur compound is used. Additives for use in such steps are given in *Research Disclosure*, Nos. 17643 and 18716, the related parts of these references being listed below.

Known photographic additives usable in the present invention are also described in the two *Research Disclosure* references shown above, the related parts of the references being listed below.

| (Kind of Additive) | (RD 17643) | (RD 18716) |
|---|---|---|
| 1 Chemical sensitizer | p. 23 | p. 648 right column |
| 2 Sensitizer | | p. 648 right column |
| 3 Spectral sensitizer, Supersensitizer | p. 23–24 | from p. 648 right column to p. 649 right column |
| 4 Brightener | p. 24 | |
| 5 Antifoggant, Stabilizer | pp. 24–25 | from p. 649 right column |
| 6 Light absorber, Filter dye, UV absorber | pp. 25–26 | from p. 649 right column to p. 650 left column |

-continued

| (Kind of Additive) | (RD 17643) | (RD 18716) |
|---|---|---|
| 7 Antistain agent | p. 25 right column | p. 650 from left to right column |
| 8 Color image stabilizer | p. 25 | |
| 9 Hardener | p. 26 | p. 651 left column |
| 10 Binder | p. 26 | p. 651 left column |
| 11 Plasticizer, Lubricant | p. 27 | p. 650 right column |
| 12 Coating aid, Surfactant | pp. 26–27 | p. 650 right column |

In order to prevent the deterioration of photographic performances caused by formaldehyde gas, a compound capable of fixing formaldehyde through reaction therewith is preferably added to the photosensitive material. Such compounds are described in U.S. Pat. Nos. 4,411,987 and 4,435,503.

Various color couplers can be used in the present invention. Examples thereof are described in the patent documents shown in *Research Disclosure* (RD), No. 17643, VII-C to G.

Preferred yellow couplers are described in, e.g., U.S. Pat. Nos. 3,933,501, 4,022,620, 4,326,024, 4,401,752, and 4,248,961, JP-B-58-10739, British Patents 1,425,020 and 1,476,760, U.S. Pat. Nos. 3,973,968, 4,314,023, and 4,511,649, and EP 249,473A.

Preferred magenta couples are 5-pyrazolone compounds and pyrazoloazole compounds. Especially preferred of such magenta couplers are described in, e.g., U.S. Pat. Nos. 4,310,619 and 4,351,897, European Patent 73,636, U.S. Pat. Nos. 3,061,432 and 3,725,067, *Research Disclosure* No. 24220 (Jun. 1984), JP-A-60-33552, *Research Disclosure* No. 24230 (Jun. 1984), JP-A-60-43659, JP-A-61-72238, JP-A-60-35730, JP-A-55-118034, JP-A-60-185951, U.S. Pat. Nos. 4,500,630, 4,540,654, and 4,556,630, and WO (PCT) 88/04795.

Examples of cyan couplers include phenol couplers and naphthol couplers. Preferred cyan couplers are described in, e.g., U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, West German OS 3,329,729, EP 121,365A, EP 249,543A, U.S. Pat. Nos. 3,446,622, 4,333,999, 4,753,871, 4,451,559, 4,427,767, 4,690,889, 4,254,212, and 4,296,199, and JP-A-61-42658.

Preferred colored couplers for compensating for the unwanted absorption of colored dyes are described in, e.g., *Research Disclosure* No. 17643, VII-G, U.S. Pat. No. 4,163,670, JP-B-57-39413, U.S. Pat. Nos. 4,004,929 and 4,138,258, and British Patent 1,146,368.

Preferred couplers which give colored dyes having excessive diffusibility are described in, e.g., U.S. Pat. No. 4,366,237, British Patent 2,125,570, European Patent 96,570, and West German publication 3,234,533.

Representative examples of polymeric dye-forming couplers are described in, e.g., U.S. Pat. Nos. 3,451,820, 4,080,211, 4,367,282, 4,409,320, and 4,576,910 and British Patent 2,102,137.

Couplers which release photographically useful residues upon coupling are advantageously used in the present invention. Preferred DIR couplers, which release a development inhibitor, are described in the patent documents shown in RD 17643, VII-F, JP-A-57-151944, JP-A-57-154234, JP-A-60-184248, JP-A-63-37346, and U.S. Pat. No. 4,248,962.

Preferred couplers which image-wise release a nucleating agent or a development accelerator during development are described in, e.g., British Patents 2,097,140 and 2,131,188, JP-A-59-157638, and JP-A-59-170840.

Examples of other couplers usable in the photosensitive material of the present invention include the competing couplers described in, e.g., U.S. Pat. No. 4,130,427; the polyequivalent couplers described in, e.g., U.S. Pat. Nos. 4,283,472, 4,338,393, and 4,310,618; the DIR redox compound-releasing couplers, DIR coupler-releasing couplers, DIR coupler-releasing redox compounds, and DIR redox-releasing redox compounds described in, e.g., JP-A-60-185950 and JP-A-62-24252; the couplers releasing a dye which recovers its color after release as described in EP 173,302A; the bleach accelerator-releasing couplers described in, e.g., RD No. 11449, RD No. 24241, and JP-A-61-201247; ligand-releasing couplers described in, e.g., U.S. Pat. No. 4,553,477; and the leuco dye-releasing couplers described in JP-A-63-75747.

The couplers for use in the present invention can be introduced into the photosensitive material using various known dispersion techniques.

Examples of high-boiling solvents for use in oil-in-water dispersion techniques are described in, e.g., U.S. Pat. No. 2,322,027.

Specific examples of high-boiling organic solvents having a boiling point at ordinary pressure of 175° C. or higher for use in oil-in-water dispersion techniques include phthalic esters, phosphoric esters, phosphonic esters, benzoic esters, amides, alcohols, phenols, aliphatic carboxylic esters, aniline derivatives, and hydrocarbons. Organic solvents having a boiling point of about from 30° C., preferably 50° C., to 160° C. may be used as auxiliary solvents. Representative examples of such auxiliary solvents include ethyl acetate, butyl acetate, ethyl propionate, methyl ethyl ketone, cyclohexanone, 2-ethoxyethyl acetate, and dimethylformamide.

Processes and effects of latex dispersion techniques and examples of latexes for impregnation are described in, e.g., U.S. Pat. No. 4,199,363 and West German Patent Applications (OLS) Nos. 2,541,274 and 2,541,230.

In the photosensitive material of the present invention, the total film thickness of all hydrophilic colloid layers formed on the emulsion layer side is preferably 28 μm or smaller, and these colloid layers preferably have a film-swelling rate $T_{1/2}$ of 30 seconds or lower. Values of the film thickness were determined after moisture conditioning (2 days) in a 25° C. atmosphere having a relative humidity of 55%. Film-swelling rates, $T_{1/2}$, can be determined according to techniques known in the art. For example, $T_{1/2}$ can be measured with a swellometer (swelling meter) of the type described in A. Green, et al., *Photogr. Sci. Eng.*, Vol. 19, No. 2, pp. 124–129. $T_{1/2}$ is defined as the time period required for a film thickness to reach ½ of the saturation film thickness which is 90% of the maximum swollen-film thickness resulting from processing with a 30° C. color developing solution for 3 minutes and 15 seconds.

The film-swelling rate, $T_{1/2}$, can be regulated by adding a hardener to the gelatin used as a binder or by changing the conditions for drying and aging after coating. The degree of swelling is preferably from 150 to 400%. The degree of swelling can be calculated from the maximum swollen-film thickness determined under the above-described conditions, using the equation (degree of swelling)=((maximum swollen-film thickness)−(film thickness))/(film thickness).

The color-photographic photosensitive material according to the present invention can be processed by the ordinary methods described in RD No. 17643, pp. 28–29 and RD No. 18716, p. 615, from left to right column.

A color developing agent may be contained in the silver halide color photosensitive material of the present invention for the purpose of enabling simpler and rapider processing. For incorporation of a color developing agent, various precursors therefor are preferably used. Examples of such precursors include the indoaniline compounds described in U.S. Pat. No. 3,342,597, the Schiff base compounds described in U.S. Pat. No. 3,342,599 and *Research Disclosure* Nos. 14850 and 15159, and other precursor compounds described in *Research Disclosure* No. 13924.

The photographic photosensitive material thus produced is preferably wound around a spool having an outer diameter of from 5 to 11 mm. Spools having an outer diameter smaller than 5 mm cannot be used because the photographic photosensitive material wound around such a thin spool develops pressure fog in the photographic emulsion. On the other hand, if a spool having an outer diameter larger than 11 mm is used, no trouble attributable to curling is caused even without conducting such a heat treatment.

The present invention will be explained below in more detail by reference to Examples, but the invention should not be construed as being limited thereto.

The evaluation/measurement methods used in the following Examples are described first.

(1) In-camera Film Loading Trouble, Outermost-lap Curl Value (i) Outermost-lap Curl Value Out of a photographic film with a predetermined length which had undergone a front-end treatment according to the present invention ("out-of-roll curling method," "BTA elimination method," etc.), a sample piece having dimensions of 35 mm (length direction) and 2 mm (width direction) was cut in a front end part 3 cm apart from the front edge. Using a curl-measuring board such as that shown in ANSI/ASC PH1.29-1985, FIG. 2, the curl of the sample piece was measured at a temperature of 25° C. and a relative humidity of 60% according to the Test Method A shown therein. The curl value is given in terms of 1/R (m) (R is the radius of the curl).

(ii) In-camera Film Loading Trouble

A photographic film with a predetermined length which had undergone a front-end treatment according to the present invention was housed in a cartridge of the type as provided for in JIS K 7519-1982, with the photosensitive layer facing inward and a front end part of the film being out of the cartridge over the length shown in Table 1.

This cartridge was fitted into a camera (Caldia Travel Mini II, manufactured by Fuji Photo Film Co., Ltd.) and automatic winding-up operation was conducted 1,000 times, during which the number of winding troubles, i.e., failures of film winding around the wind-up roll, was recorded. Thus, the "in-camera film loading trouble (%)" was determined.

(2) Innermost-lap Curl Value, Mini-lab Trouble

Samples were evaluated by the following procedure.

(i) Core Setting

Humidity conditioning: Standing overnight at 25° C., 60% RH.

Core setting: Each sample was housed in a given cartridge with the photosensitive layer facing inward, and the cartridge was placed in a sealed container at 50° C. for 24 hours.

Cooling: Standing overnight in a 25° C. room.

(ii) Evaluation for Innermost-lap Curl Value

The sample cooled was taken out of the sealed container, and the innermost-lap curl of this film was measured immediately thereafter at a temperature of 25° C. and a relative humidity of 60% according to ANSI/ASC PH1.29-1985, Test Method A. The curl value is given in terms of 1/R (m) (R is the radius of the curl).

(iii) Evaluation for Mini-lab Processability

Immediately after the measurement of innermost-lap curl, each sample was processed with a mini-lab processor (Mini-Lab FP-550B, manufactured by Fuji Photo Film Co., Ltd.; processing solution, CN-16Q). The mini-lab processing was conducted in an ordinary way, with the film end as the outer end of the film roll being fixed to the leader.

The sample film which had undergone the mini-lab processing was visually evaluated for the following.

Rear-end folding: The number of "folding" occurrences per sample was counted. Samples which suffered folding even once do not have an aptitude for market. Samples which, even though free from such folding, suffered slight folding at a corner are indicated by "E" in Table 1.

Uneven development: Samples were visually evaluated, and the length of an unevenly developed part is shown in Table 1. Samples which had even slight unevenness of development do not have an aptitude for market.

(3) Glass Transition Temperature ($T_g$), Melting Point ($T_m$)

(1) A 10-mg sample was set on an aluminum pan in a nitrogen stream.

(2) Measurement was made with a differential scanning calorimeter (DSC) by the following procedure.

(i) Heating to 300° C. at a rate of 20° C./min (1st run).

(ii) Rapid cooling to room temperature to give noncrystalline polymer.

(iii) Reheating at a rate of 20° C./min (2nd run).

$T_m$: The temperature at which the maximum endothermic peak in the 1st run had its peak top is taken as the $T_m$.

$T_g$: The temperature at which the DSC curve began to deviate from the base line in the 2nd run and the temperature at which the DSC curve reached thereafter to a new base line were arithmetically averaged to obtain the $T_g$.

Methods for carrying out the present invention are explained below in detail.

(1) Production of Supports (1-1) Production of PEN Support

Poly(ethylene 2,6-naphthalate) containing the dye compounds (I-6) and (I-24) shown below each in an amount of 54 ppm of the polyester on a solid basis and further containing 0.1% spherical silica particles having an average particle diameter of 0.3 μm was produced by transesterification in an ordinary way. This polyester had an intrinsic viscosity of 0.62.

Pellets of the polyester were dried at 170° C. for 4 hours, melted at 300° C., and then extruded with a T-die. The extrudate was rapidly cooled to produce an unstretched film regulated so as to have a film thickness of 105 μm after heat setting. This film was biaxially stretched first in the machine direction at 140° C. in a stretch ratio of 3 and successively in the transverse direction at 130° C. in a stretch ratio of 3.2. Heat setting was then conducted with 3% relaxation at 245° C. for 30 seconds. Thus, a rolled support having a width of 1.2 m and a length of 2,000 m was obtained.

(1-2) Production of Copolymer Support and Polymer Blend Supports

CP-A: A polyester copolymer consisting of dimethyl 2,6-naphthalenedicarboxylate units, dimethyl terephthalate units, and ethylene glycol units (molar ratio, 75/25/100) was produced by transesterification in an ordinary way. This polyester had an intrinsic viscosity of 0.62. To this polymer were added the same dyes and spherical silica particles as in the above-described PEN support in the same amounts. Pellets of this polymwe were dried in the same manner as in the preparation of the PEN support. The resulting pellets were melted at 300° C., extruded with a T-die, and then rapidly cooled to produce an unstretched film regulated so as to have a film thickness of 105 μm after heat setting. After this film was dried under the same conditions as for the above-described PEN support, it was biaxially stretched first in the machine direction at 140° C. in a stretch ratio of 3 and successively in the transverse direction at 130° C. in a stretch ratio of 3.2. Heat setting was then conducted with 3% relaxation at 220° C. for 30 seconds. Thus, a biaxially stretched film having a width of 1.2 m and a length of 2,000 m was obtained.

PB-A: The PEN produced by the method described above was mixed with PET having an intrinsic viscosity of 0.55 produced in an ordinary way, in a weight ratio of 60:40. To the mixture were added the same dyes and spherical silica particles as in the above-described PEN support in the same amounts. This mixture was kneaded with a twin-screw kneading extruder at 300° C., and the resulting blend was pelleted. After the pelleted blend was dried under the same conditions as for the above-described PEN, it was melted at 300° C., extruded with a T-die, and then rapidly cooled to produce an unstretched film regulated so as to have a film thickness of 105 μm after heat setting. This film was biaxially stretched first in the machine direction at 110° C. in a stretch ratio of 3 and successively in the transverse direction at 120° C. in a stretch ratio of 3.2. Heat setting was then conducted with 3% relaxation at 230° C. for 30 seconds. Thus, a roll of a film having a width of 1.2 m and a length of 2,000 m was obtained.

PB-B: A polyarylate (PAr) consisting of bisphenol A units and terephthalic acid units and having an intrinsic viscosity of 0.55 was produced in an ordinary way. A mixture (50:50 by weight ratio) of this PAr and the PEN produced by the above-described method was dried at 190° C. for 4 hours. Thereto were added the same dyes and spherical silica particles as in the above-described PEN support in the same amounts. The resulting mixture was melted at 300° C., extruded with a T-die, and then rapidly cooled to produce an unstretched film regulated so as to have a film thickness of 105 μm after heat setting. This film was biaxially stretched first in the machine direction at 155° C. in a stretch ratio of 3 and successively in the transverse direction at 160° C. in a stretch ratio of 3.2. Heat setting was then conducted with 3% relaxation at 220° C. for 30 seconds. Thus, a biaxially stretched film having a width of 1.2 m and a length of 2,000 m was obtained.

(1-3) Production of PET Support

PET polymer having an intrinsic viscosity of 0.56 was obtained in an ordinary way. After this polymer was dried under the same conditions as for the above-described PEN, the same dyes and spherical silica particles as in the above-described PEN support were added thereto in the same amounts. The resulting polymer was melted at 290° C., extruded with a T-die, and then rapidly cooled to produce an unstretched film regulated so as to have a film thickness of 105 μm after heat setting. This film was biaxially stretched first in the machine direction at 95° C. in a stretch ratio of 3.3 and successively in the transverse direction at 100° C. in a stretch ratio of 3.6. Heat setting was then conducted with 3% relaxation at 235° C. for 30 seconds. Thus, a support having a width of 1.2 m and a length of 2,000 m was obtained.

The supports used are shown in Table 1.

TABLE 1

| | Support Production | | | | Front-end Treatment: BTA elimination method | | Front-end Treatment: Out-of-roll curling method | | Fitting into Cartridge | | | | | | Mini-lab Trouble | | |
|---|---|---|---|---|---|---|---|---|---|---|---|---|---|---|---|---|---|
| Level No. | Support | $T_g$ °C. | $T_m$ °C. | BTA treatment °C. × hr | Length mm | Temp. °C. | Roll diameter mm | Temp. °C. | Spool diameter mm | Film length m | Front end length mm | Outermost-lap curl value $m^{-1}$ | In-camera film loading trouble % | Innermost-lap curl value $m^{-1}$ | Rear-end folding number | Uneven development cm | Remarks |
| 1 | PEN | 119 | 267 | 110 × 24 | 30 | 180 | — | — | 7 | 3.0 | 70 | 80 | 0 | 135 | 0 | 0 | present invention |
| 2 | PEN | 119 | 267 | 110 × 24 | — | — | 15 | 125 | 7 | 3.0 | 70 | 82 | 0 | 139 | 0 | 0 | present invention |
| 3 | PEN | 119 | 267 | 110 × 24 | — | — | — | — | 7 | 3.0 | 70 | 40 | 4.5 | 142 | 0 | 0 | comparative |
| 4 | PEN | 119 | 267 | 110 × 24 | 30 | 125 | — | — | 7 | 3.0 | 70 | 52 | 0.2 | 140 | 0 | 0 | present invention |
| 5 | PEN | 119 | 267 | 110 × 24 | 30 | 250 | — | — | 7 | 3.0 | 70 | 130 | 0.3 | 137 | 0 | 0 | present invention |
| 6 | PEN | 119 | 267 | 110 × 24 | 7 | 250 | — | — | 7 | 3.0 | 70 | 55 | 0.2 | 141 | 0 | 0 | present invention |
| 7 | PEN | 119 | 267 | 110 × 24 | — | 250 | 2 | 125 | 7 | 3.0 | 70 | 210 | 5.3 | 133 | 0 | 0 | comparative |
| 8 | PEN | 119 | 267 | 110 × 24 | — | 250 | 4 | 125 | 7 | 3.0 | 70 | 175 | 0.3 | 135 | 0 | 0 | present invention |
| 9 | PEN | 119 | 267 | 110 × 24 | — | 250 | 280 | 125 | 7 | 3.0 | 70 | 50 | 0.2 | 133 | 0 | 0 | present invention |
| 10 | PEN | 119 | 267 | 110 × 24 | — | 250 | 320 | 125 | 7 | 3.0 | 70 | 42 | 3.8 | 139 | 0 | 0 | comparative |
| 11 | PEN | 119 | 267 | 110 × 24 | — | 250 | 15 | 25 | 7 | 3.0 | 70 | 43 | 3.7 | 137 | 0 | 0 | comparative |
| 12 | PEN | 119 | 267 | 110 × 24 | — | 250 | 15 | 35 | 7 | 3.0 | 70 | 51 | 0.3 | 139 | 0 | 0 | present invention |
| 13 | PEN | 119 | 267 | 110 × 24 | — | 250 | 15 | 250 | 7 | 3.0 | 70 | 155 | 0.2 | 136 | 0 | 0 | present invention |
| 14 | PEN | 119 | 267 | 110 × 24 | — | 250 | 15 | 275 | 7 | 3.0 | 70 | *1 | 4.8 | 135 | 0 | 0 | comparative |
| 15 | PEN | 119 | 267 | 110 × 12 | 30 | 250 | 15 | 125 | 7 | 3.0 | 70 | 120 | 0.1 | 185 | E | 0 | present invention |
| 16 | PEN | 119 | 267 | 110 × 12 | 30 | 250 | 15 | 125 | 9 | 25 | 70 | 98 | 0 | 155 | 0 | 0 | present invention |
| 17 | PEN | 119 | 267 | 110 × 24 | 30 | 250 | 15 | 125 | 7 | 3.0 | 3 | 85 | 0.3 | 135 | 0 | 0 | present invention |
| 18 | PEN | 119 | 267 | 110 × 24 | 30 | 250 | 15 | 125 | 7 | 3.0 | 8 | 80 | 0 | 145 | 0 | 0 | present invention |
| 19 | CP-A | 102 | 263 | 92 × 24 | 30 | 170 | — | — | 7 | 3.0 | 70 | 82 | 0 | 165 | 0 | 0 | present invention |
| 20 | PB-A | 95 | 260 | 85 × 24 | — | — | 15 | 105 | 7 | 3.0 | 70 | 78 | 0 | 170 | 0 | 0 | present invention |

TABLE 1-continued

| | Support Production | | | | Front-end Treatment: BTA elimination method | | Front-end Treatment: Out-of-roll curling method | | Fitting into Cartridge | | | | In-camera film | | Mini-lab Trouble | | |
|---|---|---|---|---|---|---|---|---|---|---|---|---|---|---|---|---|---|
| Level No. | Support | $T_g$ °C. | $T_m$ °C. | BTA treatment °C. × hr | Length mm | Temp. °C. | Roll diameter mm | Temp. °C. | Spool diameter mm | Film length m | Front end length mm | Outermost-lap curl value $m^{-1}$ | loading trouble % | Innermost-lap curl value $m^{-1}$ | Rear-end folding number | Uneven development cm | Remarks |
| 21 | PB-B | 142 | 255 | 132 × 24 | — | — | 15 | 155 | 7 | 3.0 | 70 | 79 | 0 | 120 | 0 | 0 | invention present invention |
| 22 | PET | 70 | 256 | 68 × 48 | — | — | 15 | 95 | 7 | 3.0 | 70 | 83 | 0 | 192 | E | 0 | invention present invention |
| 23 | PET | 70 | 256 | 68 × 48 | — | — | 15 | 95 | 9 | 2.5 | 70 | 82 | 0 | 162 | 0 | 0 | invention present invention |
| 24 | PET | 70 | 256 | 68 × 48 | 30 | 180 | — | — | 9 | 2.5 | 70 | 80 | 0 | 101 | 0 | 0 | invention present invention |
| 25 | PEN | 119 | 267 | — | — | — | 15 | 125 | 9 | 2.5 | 70 | 115 | 0 | 175 | E | 0 | invention present invention |

*1: unable to be measured because of severe deformation.

The supports were subjected to the surface treatment, formation of an electrically conductive layer, BTA treatment, and subbing described below.

(2) Surface Treatment of Supports

The supports were subjected to the glow surface treatment shown below.

Four cylindrical electrodes each having a diameter of 2 cm and a length of 120 cm were fixed to an insulating plate at an interval of 10 cm. This electrode plate was fixed within a vacuum tank. Each support was caused to travel while facing the electrode plane at a distance of 15 cm so that 2-second surface treatment was conducted. A thermostatic heating roll having a diameter of 50 cm was disposed so that the film came into contact therewith over ¾ of a lap just before passing by the electrodes. Further, a thermocouple thermometer was contacted to the film surface between the heating roll and the electrode zone to thereby regulate the film surface so as to have the temperature lower by 5° C. than the $T_g$ of the film.

The surface treatment was conducted at an internal pressure of the vacuum tank of 0.2 Torr, a partial $H_2O$ pressure of the atmosphere of 75%, and a discharge frequency of 30 kHz. The intensity of the treatment for each level is shown in Table 1. The vacuum glow discharge electrodes were as described in JP-A-7-3056. Before the support which had undergone the discharge treatment was wound up, it was contacted with a thermostatic cooling roll having a diameter of 50 cm to lower the surface temperature of the support to 30° C.

(3) Formation of First Back Layer (electrically conductive layer)

In 3,000 parts by weight of ethanol were dissolved 230 parts of stannic chloride hydrate and 23 parts by weight of antimony trichloride. To this homogeneous solution was dropwise added 1N aqueous sodium hydroxide solution until the ethanol solution came to have a pH of 3. Thus, a colloid of coprecipitated stannic oxide and antimony oxide was obtained. This precipitate was allowed to stand at 50° C. for 24 hours to obtain a red-brown colloidal precipitate.

The red-brown colloidal precipitate was centrifuged. Water was added to the precipitate to conduct centrifugal washing with water in order to remove excess ions. The above operation was repeated three times to remove the excess ions.

Into 1,500 parts by weight of water was redispersed 200 parts by weight of the colloidal precipitate from which the excess ions had been removed. The dispersion was atomized in a furnace heated at 500° C. to obtain fine bluish particles of a mixed metal oxide consisting of stannic oxide and antimony oxide which had an average particle diameter of 0.005 μm. The fine particles had a resistivity of 25 Ω·cm.

A mixture of 40 parts by weight of the fine particles and 60 parts by weight of water was regulated so as to have a pH of 7.0, subsequently roughly stirred with a stirrer, and then treated with a horizontal sand mill (Dynomill, manufactured by Willy A. Backfen AG) for a residence time of 30 minutes to prepare a dispersion in which the primary particles had partly aggregated to 0.05-μm secondary particles.

A liquid prepared according to the following formulation was applied in such an amount as to result in a dry thickness of 0.3 μm, and the coating was dried at 110° C. for 30 seconds.

| | |
|---|---|
| The above-described dispersion of fine electro-conductive particles ($SnO_2/Sb_2O_2$, 0.15 μm) | 100 parts by weight |
| Gelatin (limed gelatin containing 100 ppm $Ca^{++}$) | 10 parts by weight |
| Water | 270 parts by weight |
| Methanol | 600 parts by weight |
| Resorcinol | 20 parts by weight |
| Nonionic surfactant (Nonionic surfactant I-13 described in JP-B-3-27099) | 0.1 part by by weight |

(4) Knurling

A knurl pattern having a width of 10 mm and a height of 20 μm was formed along each side edge of each support over the whole length according to an Example of JP-B-57-36129.

(5) Heat Treatment of Supports

Each support which had undergone the surface treatment and been coated with the first back layer was passed through a zone having the temperature shown in Table 1 to heat the support. After the heated support was wound up in a wind-up chamber kept at that temperature, the resulting roll was placed in a thermostatic chamber kept at that temperature to conduct heat treatment for the period shown in Table 1. In the above procedure, the winding of each support around a core was conducted in such a manner that the back-layer side faced inward. Conditions for this winding are as follows.

Core : Hollow aluminum core with a diameter of 300 mm and a length of 1,500 mm

Support : Width, 1,200 mm; length, 2,000 m

Winding tension: Innermost part, 15 kg/m; outermost part, 10 kg/m (6) Formation of Subbing Layer (on the emulsion-layer side)

A subbing fluid having the following composition was applied to each support with a wire-wound bar in an amount of 10 ml/$m^2$ and then dried at 115° C. for 2 minutes, before the coated support was wound up.

| | |
|---|---|
| Gelatin | 10.0 parts by weight |
| Water | 24.0 parts by weight |
| Methanol | 961.0 parts by weight |
| Salicylic acid | 3.0 parts by weight |
| Polyamide-epichlorohydrin resin produced according to the Synthesis Example 1 given in JP-A-51-3619 | 0.5 parts by weight |
| Nonionic surfactant (Nonionic surfactant I-13 described in JP-B-3-27099) | 0.1 part by weight |

(7) Formation of Second Back Layer

After each support had undergone the surface treatment and been coated with the subbing layer and the first back layer (electrically conductive layer), a liquid prepared according to the following formulation was applied in such an amount as to result in a dry thickness of 1.2 μm. The coating was dried at the temperature lower by 5° C. than the $T_g$.

| | |
|---|---|
| Diacetylcellulose | 100 parts by weight |
| Trimethylolpropane-3-toluene diisocyanate | 25 parts by weight |
| Methyl ethyl ketone | 1,050 parts by weight |
| Cyclohexanone | 1,050 parts by weight |

(8) Formation of Third Back Layer (slipping layer)

(8-1) Preparation of First Slipping-layer Liquid

A first liquid having the following composition was prepared by dissolving the solid ingredients with heating at 90° C. This first liquid was added to a second liquid, and the mixture was treated with a high-pressure homogenizer to give a stock dispersion.

| First Liquid | |
|---|---|
| Slipping agent (S3-4) | 0.7 g |
| Slipping agent (S1-2) | 1.1 g |
| Xylene | 2.5 g |

(8-2) Preparation of Second Slipping-layer Liquid

The following binders and solvents were added to the first slipping-layer liquid to obtain a coating fluid.

| | |
|---|---|
| Propylene glycol monomethyl ether | 34.0 g |
| Diacetylcellulose | 3.0 g |
| Acetone | 600.0 g |
| Cyclohexanone | 350.0 g |

(8-3) Formation of Slipping Layer

For each level, the coating fluid was applied on the uppermost back layer with a wire-wound bar in an amount of 10 cc/m$^2$.

(9) Production of Photosensitive Materials

Layers respectively having the compositions shown below were formed on each support by coating to produce multilayered color photosensitive material samples.

(Composition of Photosensitive Layer)

Major ingredients used for the constituent layers are classified as follows.

ExC: cyan coupler

ExM: magenta coupler

ExY: yellow coupler

ExS: sensitizing dye

UV: ultraviolet absorber

HBS: high-boiling organic solvent

H: gelatin hardener

The numeral following each ingredient indicates the coated amount of the ingredient in terms of g/m$^2$, provided that the coated amount of each silver halide is given in terms of silver amount, and that the coated amount of each sensitizing dye is given as the molar amount thereof per mol of the silver halide contained in the same layer.

| First layer (antihalation layer) | |
|---|---|
| Black colloidal silver | silver 0.09 |
| Gelatin | 1.60 |
| ExM-1 | 0.12 |
| ExF-1 | $2.0 \times 10^{-3}$ |
| Solid disperse dye ExF-2 | 0.030 |

-continued

| | |
|---|---|
| Solid disperse dye ExF-3 | 0.040 |
| HBS-1 | 0.15 |
| HBS-2 | 0.02 |
| Second layer (interlayer) | |
| Silver iodobromide emulsion M | silver 0.065 |
| ExC-2 | 0.04 |
| Poly(ethyl acrylate) latex | 0.20 |
| Gelatin | 1.04 |
| Third layer (low-sensitivity red-sensitive emulsion layer) | |
| Silver iodobromide emulsion A | silver 0.25 |
| Silver iodobromide emulsion B | silver 0.25 |
| ExS-1 | $6.9 \times 10^{-5}$ |
| ExS-2 | $1.8 \times 10^{-5}$ |
| ExS-3 | $3.1 \times 10^{-4}$ |
| ExC-1 | 0.17 |
| ExC-3 | 0.030 |
| ExC-4 | 0.10 |
| ExC-5 | 0.020 |
| ExC-6 | 0.010 |
| Cpd-2 | 0.025 |
| HBS-1 | 0.10 |
| Gelatin | 0.87 |
| Fourth layer (medium-sensitivity red-sensitive emulsion layer) | |
| Silver iodobromide emulsion C | silver 0.70 |
| ExS-1 | $3.5 \times 10^{-4}$ |
| ExS-2 | $1.6 \times 10^{-5}$ |
| ExS-3 | $5.1 \times 10^{-4}$ |
| ExC-1 | 0.13 |
| ExC-2 | 0.060 |
| ExC-3 | 0.0070 |
| ExC-4 | 0.090 |
| ExC-5 | 0.015 |
| ExC-6 | 0.0070 |
| Cpd-2 | 0.023 |
| HBS-1 | 0.10 |
| Gelatin | 0.75 |
| Fifth layer (high-sensitivity red-sensitive emulsion layer) | |
| Silver iodobromide emulsion D | silver 1.40 |
| ExS-1 | $2.4 \times 10^{-4}$ |
| ExS-2 | $1.0 \times 10^{-4}$ |
| ExS-3 | $3.4 \times 10^{-4}$ |
| ExC-1 | 0.10 |
| ExC-3 | 0.045 |
| ExC-6 | 0.020 |
| ExC-7 | 0.010 |
| Cpd-2 | 0.050 |
| HBS-1 | 0.22 |
| HBS-2 | 0.050 |
| Gelatin | 1.10 |
| Sixth layer (interlayer) | |
| Cpd-1 | 0.090 |
| Solid disperse dye ExF-4 | 0.030 |
| HBS-1 | 0.050 |
| Poly(ethyl acrylate) latex | 0.15 |
| Gelatin | 1.10 |
| Seventh layer (low-sensitivity green-sensitive emulsion layer) | |
| Silver iodobromide emulsion E | silver 0.15 |
| Silver iodobromide emulsion F | silver 0.10 |
| Silver iodobromide emulsion G | silver 0.10 |
| ExS-4 | $3.0 \times 10^{-5}$ |
| ExS-5 | $2.1 \times 10^{-4}$ |
| ExS-6 | $8.0 \times 10^{-4}$ |
| ExM-2 | 0.33 |
| ExM-3 | 0.086 |
| ExY-1 | 0.015 |
| HBS-1 | 0.30 |
| HBS-3 | 0.010 |
| Gelatin | 0.73 |

-continued

| | |
|---|---|
| Eighth layer (medium-sensitivity green-sensitive emulsion layer) | |
| Silver iodobromide emulsion H | silver 0.80 |
| ExS-4 | $3.2 \times 10^{-5}$ |
| ExS-5 | $2.2 \times 10^{-4}$ |
| ExS-6 | $8.4 \times 10^{-4}$ |
| ExC-8 | 0.010 |
| ExM-2 | 0.10 |
| ExM-3 | 0.025 |
| ExY-1 | 0.018 |
| ExY-4 | 0.010 |
| ExY-5 | 0.040 |
| HBS-1 | 0.13 |
| HBS-3 | $4.0 \times 10^{-3}$ |
| Gelatin | 0.80 |
| Ninth layer (high-sensitivity green-sensitive emulsion layer) | |
| Silver iodobromide emulsion I | silver 1.25 |
| ExS-4 | $3.7 \times 10^{-5}$ |
| ExS-5 | $8.1 \times 10^{-5}$ |
| ExS-6 | $3.2 \times 10^{-4}$ |
| ExC-1 | 0.010 |
| ExM-1 | 0.020 |
| ExM-4 | 0.025 |
| ExM-5 | 0.040 |
| Cpd-3 | 0.040 |
| HBS-1 | 0.25 |
| Poly(ethyl acrylate) latex | 0.15 |
| Gelatin | 1.33 |
| Tenth layer (yellow filter layer) | |
| Yellow colloidal silver | silver 0.015 |
| Cpd-1 | 0.16 |
| Solid disperse dye ExF-5 | 0.060 |
| Solid disperse dye ExF-6 | 0.060 |
| Oil-soluble dye ExF-7 | 0.010 |
| HBS-1 | 0.60 |
| Gelatin | 0.60 |
| Eleventh layer (low-sensitivity blue-sensitive emulsion layer) | |
| Silver iodobromide emulsion J | silver 0.09 |
| Silver iodobromide emulsion K | silver 0.09 |
| ExS-7 | $8.6 \times 10^{-4}$ |
| ExC-8 | $7.0 \times 10^{-4}$ |
| ExY-1 | 0.050 |
| ExY-2 | 0.22 |
| ExY-3 | 0.50 |
| ExY-4 | 0.020 |
| Cpd-2 | 0.10 |
| Cpd-3 | $4.0 \times 10^{-3}$ |
| HBS-1 | 0.28 |
| Gelatin | 1.20 |

-continued

| | |
|---|---|
| Twelfth layer (high-sensitivity blue-sensitive emulsion layer) | |
| Silver iodobromide emulsion L | silver 1.00 |
| ExS-7 | $4.0 \times 10^{-4}$ |
| ExY-2 | 0.10 |
| ExY-3 | 0.10 |
| ExY-4 | 0.010 |
| Cpd-2 | 0.10 |
| Cpd-3 | $1.0 \times 10^{-3}$ |
| HBS-1 | 0.070 |
| Gelatin | 0.70 |
| Thirteenth layer (first protective layer) | |
| UV-1 | 0.19 |
| UV-2 | 0.075 |
| UV-3 | 0.065 |
| ExF-8 | 0.045 |
| ExF-9 | 0.050 |
| HBS-1 | $5.0 \times 10^{-2}$ |
| HBS-4 | $5.0 \times 10^{-2}$ |
| Gelatin | 1.8 |
| Fourteenth layer (second protective layer) | |
| Silver iodobromide emulsion M | silver 0.10 |
| H-1 | 0.40 |
| B-1 (diameter, 1.7 μm) | $5.0 \times 10^{-2}$ |
| B-2 (diameter, 1.7 μm) | 0.15 |
| B-3 | 0.05 |
| S-1 | 0.20 |
| Gelatin | 0.70 |

Each layer further contained additives suitably selected from W-1 to W-3, B-4 to B-6, F-1 to F-17, iron salts, lead salts, gold salts, platinum salts, palladium salts, iridium salts, and rhodium salts for the purpose of improving storage stability, processability, pressure resistance, mildew resistance, bacteria resistance, antistatic properties, and applicability.

The emulsions used are shown in Table 2.

TABLE 2

| Emulsion | Average AgI content (%) | Coefficient of variation in AgI content among grains (%) | Average diameter of grains in terms of corresponding spheres (μm) | Coefficient of variation in grain diameter (%) | Diameter of projected area in terms of corresponding circle (μm) | Diameter/ thickness ratio |
|---|---|---|---|---|---|---|
| A | 1.7 | 10 | 0.46 | 15 | 0.56 | 5.5 |
| B | 3.5 | 15 | 0.57 | 20 | 0.78 | 4.0 |
| C | 8.9 | 25 | 0.66 | 25 | 0.87 | 5.8 |
| D | 8.9 | 18 | 0.84 | 26 | 1.03 | 3.7 |
| E | 1.7 | 10 | 0.46 | 15 | 0.56 | 5.5 |
| F | 3.5 | 15 | 0.57 | 20 | 0.78 | 4.0 |
| G | 8.8 | 25 | 0.61 | 23 | 0.77 | 4.4 |
| H | 8.8 | 25 | 0.61 | 23 | 0.77 | 4.4 |
| I | 8.9 | 18 | 0.84 | 26 | 1.03 | 3.7 |
| J | 1.7 | 10 | 0.46 | 15 | 0.50 | 4.2 |
| K | 8.8 | 18 | 0.64 | 23 | 0.85 | 5.2 |
| L | 14.0 | 25 | 1.28 | 26 | 1.46 | 3.5 |
| M | 1.0 | — | 0.07 | 15 | — | 1 |

In Table 2, (A) Emulsions J to L had undergone reduction sensitization with thiourea dioxide and a thiosulfonic acid during grain preparation, according to an Example described in JP-A-2-191938;

(2) Emulsions A to I each had undergone gold sensitization, sulfur sensitization, and selenium sensitization in the presence of the spectrally sensitizing dye shown in the compositional description of the corresponding photosensitive layer and sodium thiocyanate, according to an Example of JP-A-3-237450;

(C) For the preparation of the tabular grains, low-molecular gelatin was used according to an Example described in JP-A-1-158426;

(D) The tabular grains had dislocation lines as described in JP-A-3-237450, which were observed with a high-pressure electron microscope;

(E) Emulsion L was composed of double-layer-structure grains each containing a core with a high iodine content, as described in JP-A-60-143331.

Preparation of Dispersions of Organic Solid Disperse Dyes

ExF-2 specified below was dispersed by the following method. In a 700-ml pot mill were placed 21.7 ml of water, 3 ml of a 5% aqueous solution of sodium p-octylphenoxyethoxyethoxyethanesulfonate, and 0.5 g of a 5% aqueous solution of p-octylphenoxy polyoxyethylene ether (degree of polymerization, 10). Thereto were added 5.0 g of dye ExF-2 and 500 ml of zirconium oxide beads (diameter, 1 mm). The contents were dispersed for 2 hours using vibrating ball mill Type BO, manufactured by Chuo Koki, Japan. After the dispersion treatment, the contents were taken out and added to 8 g of 12.5% aqueous gelatin solution. The beads were removed by filtration to obtain a gelatin dispersion of the dye. The fine dye particles had an average particle diameter of 0.44 μm.

Dispersions of solid dyes ExF-3, ExF-4, and ExF-6 were obtained in the same manner. The average particle diameters of the fine particles of those dyes are 0.24 μm, 0.45 μm, and 0.52 μm, respectively. ExF-5 was dispersed by the micro-precipitation dispersion method described in the Example 1 of EP 549489A. The average particle diameter thereof was 0.06 μm.

ExC-1

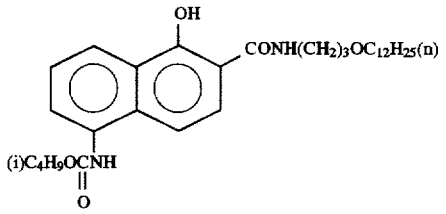

ExC-2

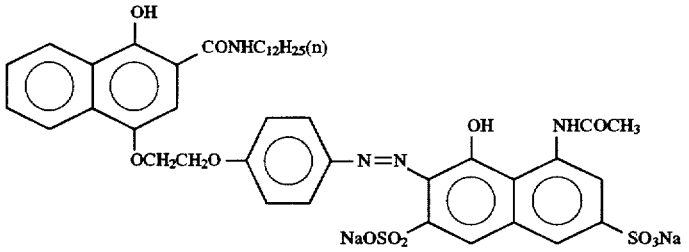

ExC-3

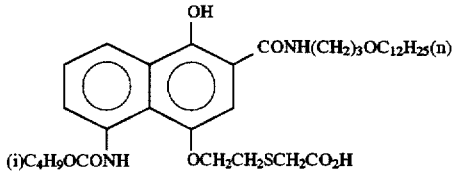

ExC-4

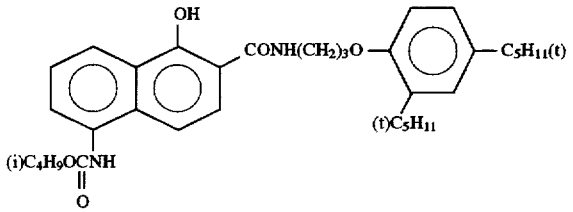

-continued
ExC-5
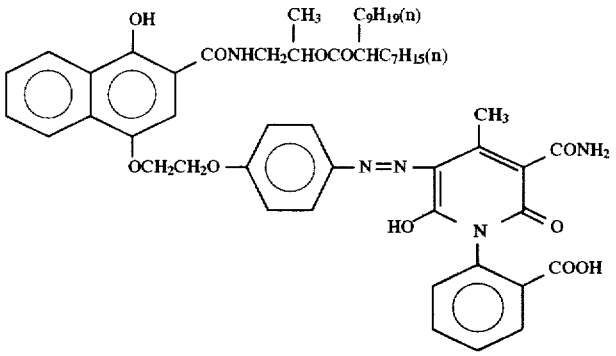
ExC-6
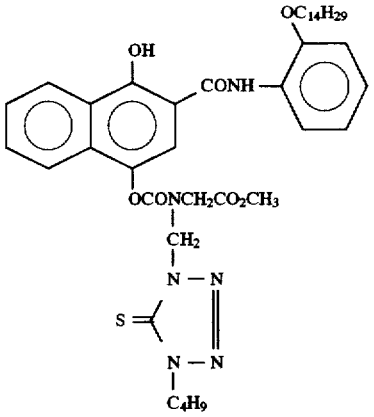
ExC-7
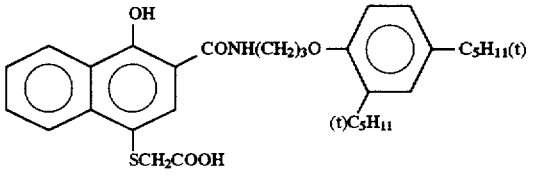
ExC-8
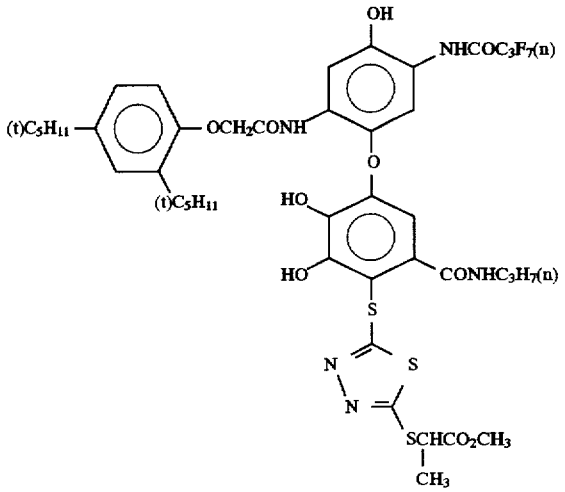

-continued
ExM-1
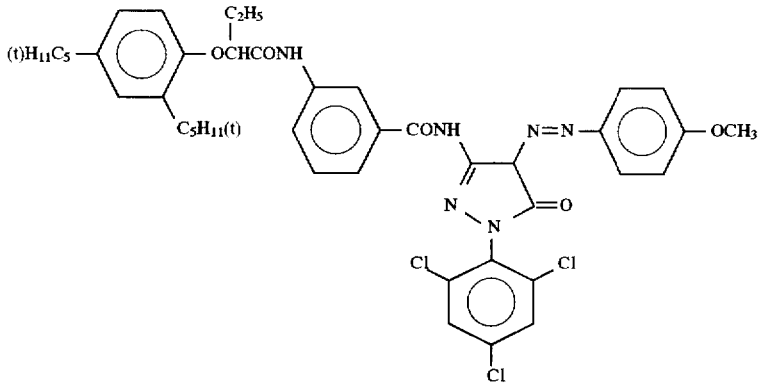
ExM-2
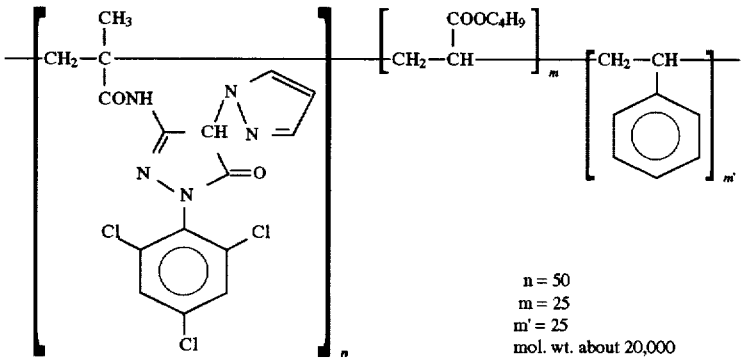
n = 50
m = 25
m' = 25
mol. wt. about 20,000
ExM-3
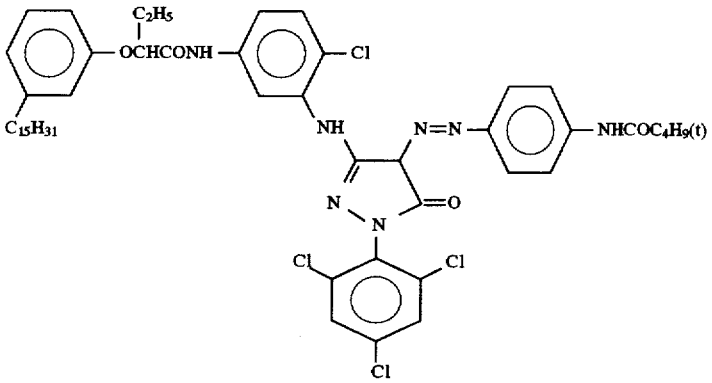
ExM-4
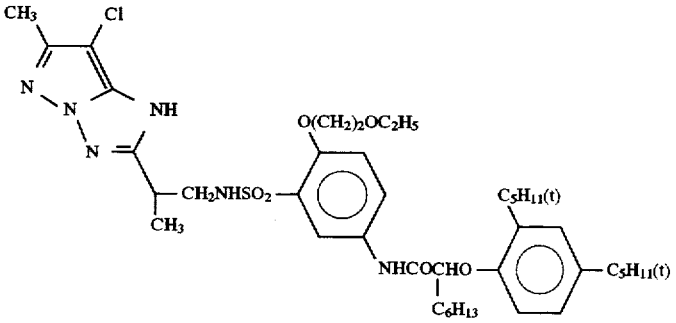

-continued
ExM-5
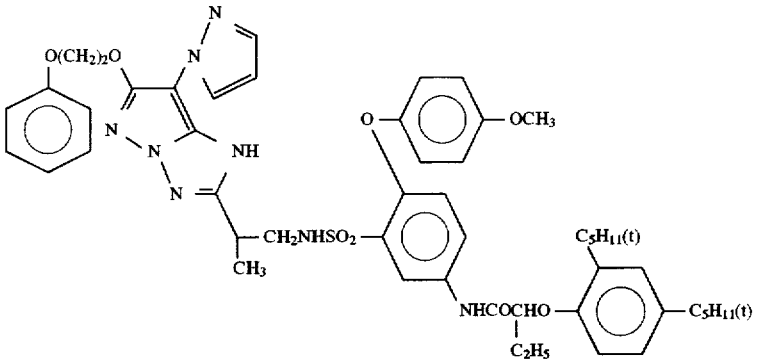
ExY-1
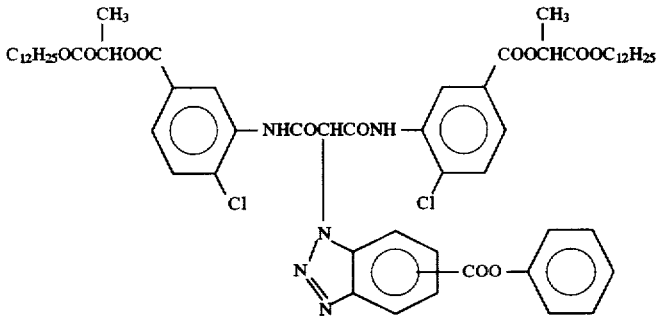
ExY-2
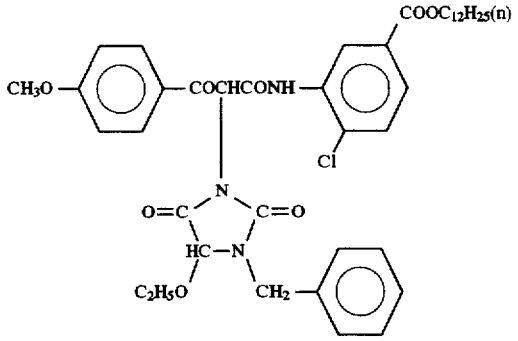
ExY-3
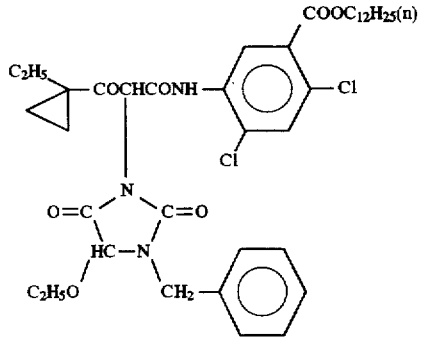

-continued
ExY-4
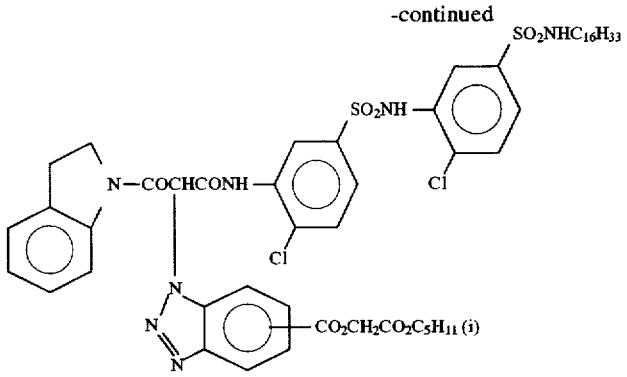
ExY-5
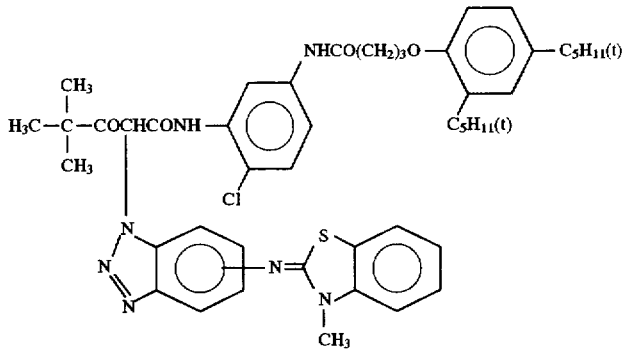
ExF-1
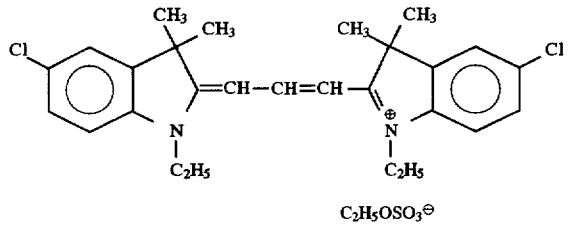
ExF-2
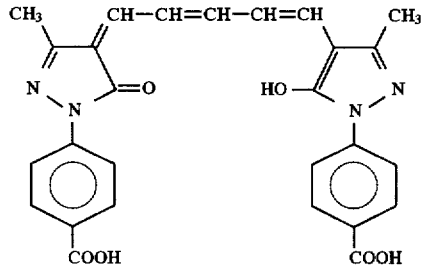
ExF-3
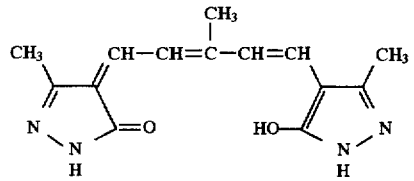
ExF-4
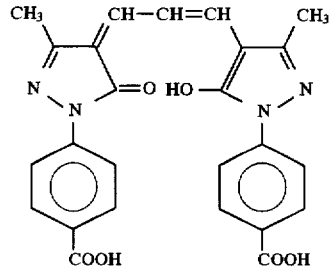

-continued
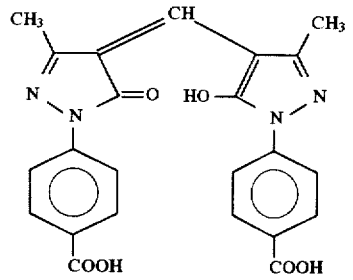
ExF-5
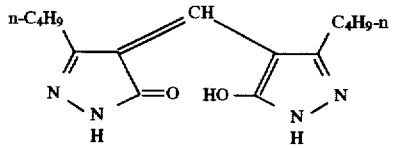
ExF-6
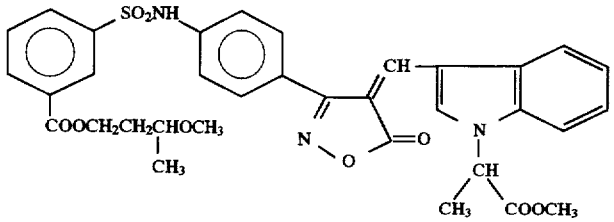
ExF-7
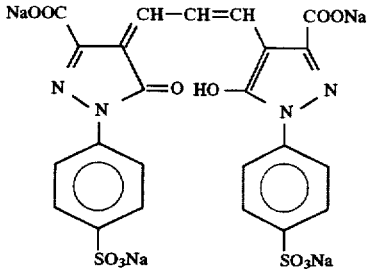
ExF-8
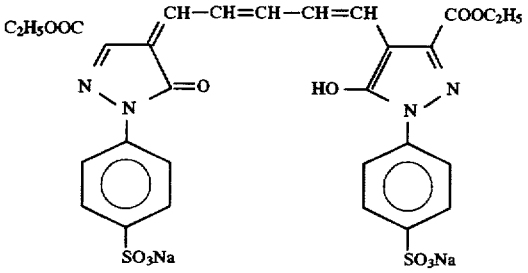
ExF-9
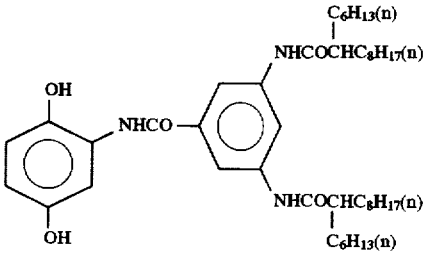
Cpd-1
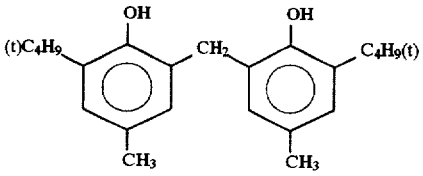
Cpd-2

-continued
Cpd-3
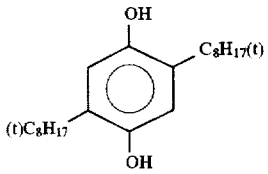
UV-1
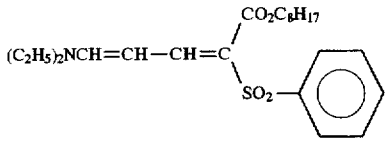
UV-2
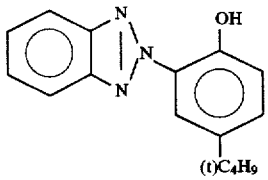
UV-3
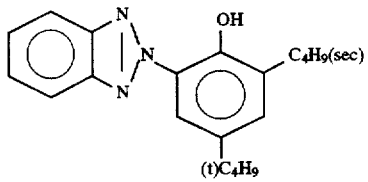
tricresyl phosphate HBS-1
di-n-butyl phthalate HBS-2
HBS-3
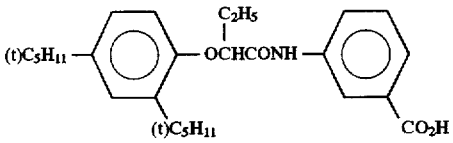
tri(2-ethylhexyl) phosphate HBS-4
ExS-1
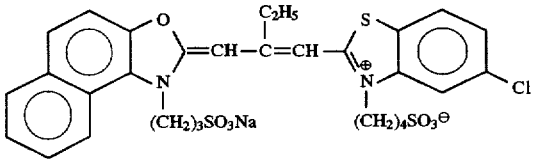
ExS-2
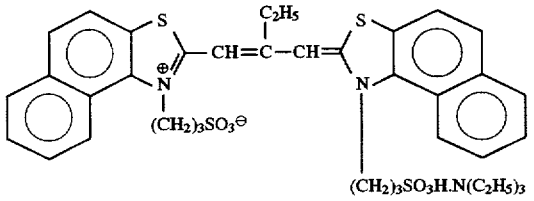
ExS-3
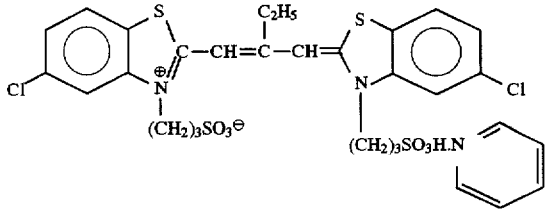

-continued
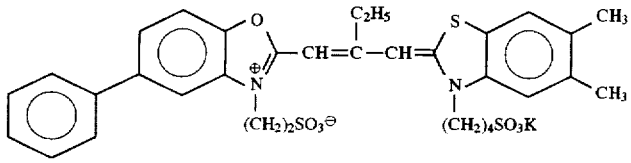
ExS-4
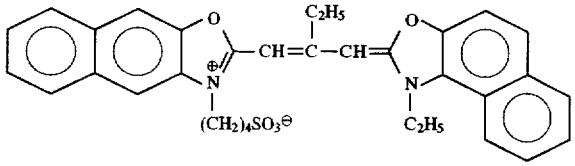
ExS-5
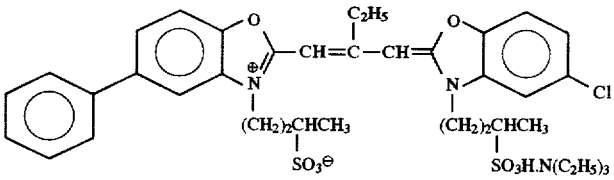
ExS-6
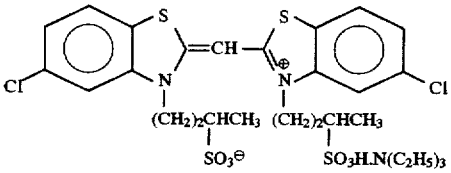
ExS-7
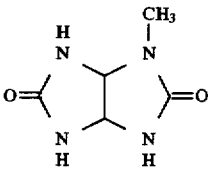
S-1
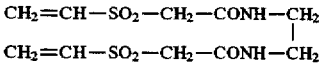
H-1
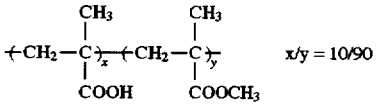
x/y = 10/90
B-1
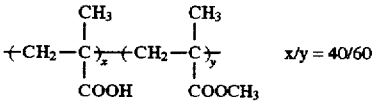
x/y = 40/60
B-2
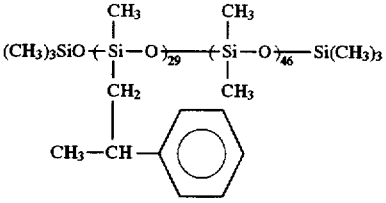
B-3
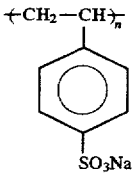
B-4

-continued
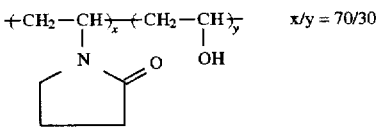
x/y = 70/30
B-5
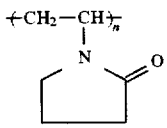
(mol. wt. about 10,000)
B-6
W-1
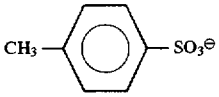
W-2
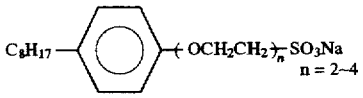
W-3
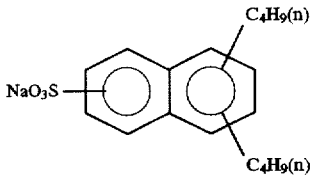
F-1
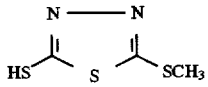
F-2
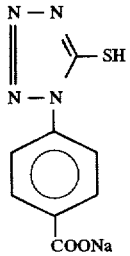
F-3
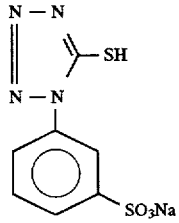
F-4
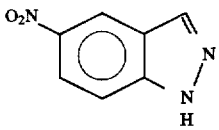
F-5
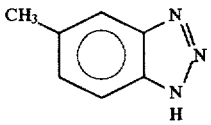

-continued
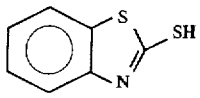
F-6
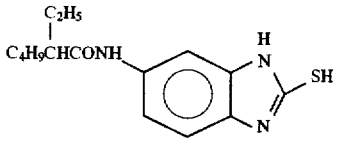
F-7
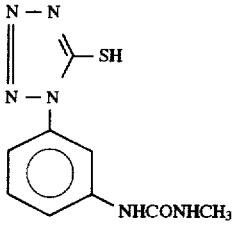
F-8
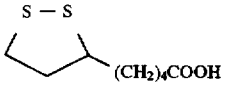
F-9
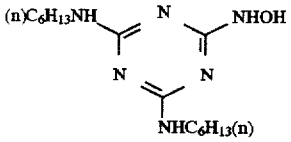
F-10
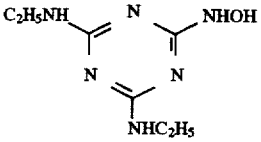
F-11
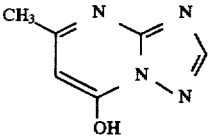
F-12
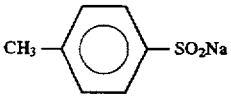
F-13
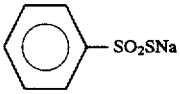
F-14
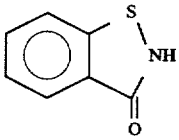
F-15
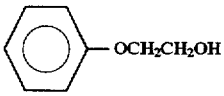
F-16
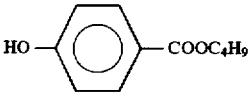
F-17

-continued (I-6)

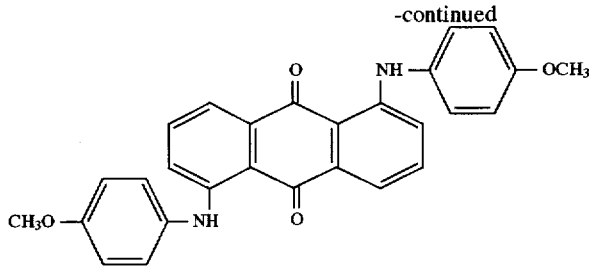

(I-24)

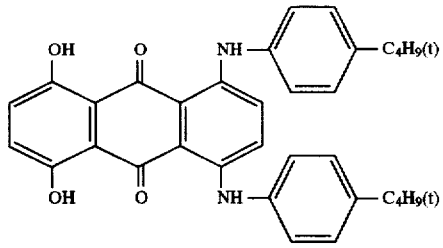

(11) Slitting, Front-end Treatment, and Evaluation

The thus-produced photographic photosensitive films for all levels were slit into a width of 35 mm in an ordinary way, and then cut into the lengths shown in Table 1. Thereafter, the films were subjected to perforation and cutting for forming a front end part, according to JIS K 7519. The resulting perforated films were housed in cartridges in the ordinary 135 format, and then subjected to a "front-end treatment" by the "BTA elimination method" and "out-of-roll curling method" described below.

(1) BTA Elimination Method

A front end part of a film having the length shown in Table 1 was contacted with a heated stainless-steel roller to eliminate BTA. The temperature and diameter of this roller are shown in Table 1. The contact time was 15 seconds for each film.

(2) Out-of-roll Curling Method

A 70-mm front end part of a film was wound around a roll, with the photosensitive layer facing inward. The temperature and diameter of this roll are shown in Table 1. The contact time was 20 seconds for each film.

After the "front-end treatment" was conducted by methods (1) and (2) described above, each photographic film was housed in an ordinary 135 cartridge, with a front end part of the film being out of the cartridge over the length shown in Table 1.

In the case of the "BTA elimination method," the films were evaluated for the "in-camera film loading trouble" and the "outermost-lap curl value" after one-week storage at 25° C. and 60% RH. In the case of the "out-of-roll curling method," the films were evaluated for those properties immediately after the front-end treatment. The results obtained are shown in Table 1.

Further, those films housed in cartridges were subjected to core setting at 50° C. for 24 hours, and then evaluated for "innermost-lap curl value" and "mini-lab trouble" by the methods described hereinabove. The results obtained are shown in Table 1.

It can be seen from the above results that by conducting the "out-of-roll treatment" of the present invention, in-camera film loading troubles can be diminished significantly. The same effect is achieved with either of the "BTA elimination method" and the "out-of-roll curling method."

Besides the photographic films employing PEN, the effect of the present invention is produced also in the photographic films employing the PEN-based polymer blends (PB-A and PB-B) and the copolymer produced mainly from 2,6-naphthalenedicarboxylic acid and ethylene glycol (CP-A). In the case of using PET, the same effect can be obtained, although the photographic film is more easily curled than PEN films and hence the spool of the cartridge therefor has a larger diameter, i.e., the housed film has a shorter length.

According to the present invention, a photographic cartridge and a photographic photosensitive film both having excellent in-camera handleability and a preparation method for obtaining the film are provided because: the method for preparing a photographic photosensitive film comprising a support and formed on at least one side thereof photographic constituent layers containing a photosensitive silver halide emulsion layer comprises subjecting the photographic photosensitive film to a "out-of-roll curling treatment" so as to result in an outermost-lap curl value of from 55 $m^{-1}$ to 200 $m^{-1}$ as measured after the treated film is housed in a cartridge, with the emulsion layer side facing inward; the photographic photosensitive film, which comprises a polyester support and formed on at least one side thereof photographic constituent layers containing a photosensitive silver halide emulsion layer, has been prepared by the method described above; and the photographic film cartridge contains housed therein the photographic photosensitive film so that a front end part of the film is out of the cartridge over a length of at least 1 cm. Therefore, the photographic photosensitive film can be easily fitted into a camera.

In particular, the present invention is highly effective in easily fitting films into cameras of the recent automatic film-loading type. Furthermore, a photographic photosensitive film employing a polyester support and used for a slender patrone for use in a thin camera can be made to be easily fitted into such a camera.

While the invention has been described in detail and with reference to specific embodiments thereof, it will be apparent to one skilled in the art that various changes and modifications can be made therein without departing from the spirit and scope thereof.

What is claimed is:

1. A method for preparing a photographic photosensitive film comprising a support having provided on at least one side thereof photographic constituent layers containing a photosensitive silver halide emulsion layer, the photographic photosensitive film having a front end part and a rear end part, wherein the front end part has a length of from 5 mm to 300 mm, the process comprising the steps of:

heating the entire support at a temperature of from 50° C. to the glass transition temperature ($T_g$) of the support; and subjecting the photographic photosensitive film to a front-end treatment such that the photographic photosensitive film has an outermost-lap curl value of from 45 $m^{-1}$ to 200 $m^{-1}$ as measured after the treated film is housed in a cartridge, with the emulsion layer side facing inward, wherein the front-end treatment is accomplished by a BTA elimination method in which only the front end part is treated at a temperature not lower than the glass transition temperature ($T_g$) of the support and not higher than the melting point ($T_m$) of the support, before the film is wound into a cartridge to curl the film, thereby rendering the front end part more apt to be curled than the rear end part.

2. The method for preparing a photographic photosensitive film of claim 1, wherein the BTA elimination method temperature is from the glass transition temperature ($T_g$) of the support plus 10° C. to the melting point ($T_m$) of the support minus 20° C.

3. The method for preparing a photographic photosensitive film of claim 1, wherein a period for the front-end treatment is from 3 seconds to 30 minutes.

4. The method for preparing a photographic photosensitive film of claim 1, further comprising performing a curling treatment at a temperature of from 10° C. to the glass transition temperature ($T_g$) of the support.

5. The method for preparing a photographic photosensitive film of claim 1, wherein the support is composed of a polyester.

6. A method for preparing a photographic photosensitive film comprising a support having provided on at least one side thereof photographic constituent layers containing a photosensitive silver halide emulsion layer, the photographic photosensitive film having a front end part and a rear end part, the process comprising the steps of:

heating the entire support at a temperature of from 50° C. to the glass transition temperature ($T_g$) of the support; and subjecting the photographic photosensitive film to a front-end treatment such that the photographic photosensitive film has an outermost-lap curl value of from 45 $m^{-1}$ to 200 $m^{-1}$ as measured after the treated film is housed in a cartridge, with the emulsion layer side facing inward, wherein the front-end treatment is carried out by winding the front end part around a member such that the winding diameter of the front end part is from 3 mm to 300 mm, with the emulsion layer side facing inward, and heat-treating the wound front end part at a temperature not lower than 30° C. and not higher than the melting point ($T_m$) of the support, thereby rendering the front end part more apt to be curled than the rear end part.

7. The method for preparing a photographic photosensitive film of claim 6, wherein the front-end treatment temperature is from 40° C. to the melting point ($T_m$) of the support minus 20° C.

8. The method for preparing a photographic photosensitive film of claim 7, wherein the front-end treatment temperature is from 50° C. to the melting point ($T_m$) of the support minus 50° C.

9. The method for preparing a photographic photosensitive film of claim 6, wherein a period for the front-end treatment is from 3 seconds to 30 minutes.

10. The method for preparing a photographic photosensitive film of claim 6, wherein the support is composed of a polyester.

* * * * *

UNITED STATES PATENT AND TRADEMARK OFFICE

CERTIFICATE OF CORRECTION

PATENT NO. : 5,795,705

DATED : August 18, 1998

INVENTOR(S) : Fumio KAWAMOTO

It is certified that error appears in the above-identified patent and that said Letters Patent is hereby corrected as shown below:

On the title page,

-- [30] Foreign Application Priority Data

July 21, 1995 [JP] Japan 7-206725 --.

Signed and Sealed this

Eighth Day of June, 1999

*Attest:*

Q. TODD DICKINSON

*Attesting Officer*

*Acting Commissioner of Patents and Trademarks*